US012075921B2

(12) United States Patent
Machael et al.

(10) Patent No.: US 12,075,921 B2
(45) Date of Patent: Sep. 3, 2024

(54) CHAIRS INCLUDING FLEXIBLE FRAMES

(71) Applicant: HNI Technologies Inc., Muscatine, IA (US)

(72) Inventors: Jay R. Machael, Muscatine, IA (US); Douglas A. Schroeder, Muscatine, IA (US)

(73) Assignee: HNI TECHNOLOGIES INC., Muscatine, IA (US)

( * ) Notice: Subject to any disclaimer, the term of this patent is extended or adjusted under 35 U.S.C. 154(b) by 0 days.

(21) Appl. No.: 18/108,234

(22) Filed: Feb. 10, 2023

(65) Prior Publication Data

US 2023/0301437 A1 Sep. 28, 2023

Related U.S. Application Data

(62) Division of application No. 16/745,120, filed on Jan. 16, 2020, now Pat. No. 11,589,678.

(60) Provisional application No. 62/793,729, filed on Jan. 17, 2019.

(51) Int. Cl.
*A47C 7/44* (2006.01)

(52) U.S. Cl.
CPC ..... *A47C 7/445* (2013.01)

(58) Field of Classification Search
CPC ..... A47C 7/445
See application file for complete search history.

(56) References Cited

U.S. PATENT DOCUMENTS

| | | | |
|---|---|---|---|
| 9,851 | A | 7/1853 | Bailey |
| 320,806 | A | 6/1885 | Long |
| 326,241 | A | 9/1885 | Preston. |
| 455,168 | A | 6/1891 | Case |
| 518,097 | A | 4/1894 | Derby |
| 542,390 | A | 7/1895 | Linn |
| 674,912 | A | 5/1901 | Ellenbecker |
| 868,052 | A | 10/1907 | Wilmot |
| 942,818 | A | 12/1909 | Flindall. |
| 1,210,223 | A | 12/1916 | August |
| 1,256,726 | A | 2/1918 | Pike |
| 1,368,397 | A | 2/1921 | Hussander |
| 1,644,336 | A | 10/1927 | Gunlocke et al. |
| 1,882,169 | A | 10/1932 | Wedler |
| 1,890,102 | A | 12/1932 | Urquhart |

(Continued)

FOREIGN PATENT DOCUMENTS

| | | | |
|---|---|---|---|
| CH | 267914 | A | 4/1950 |
| DE | 1118414 | B | 11/1961 |

(Continued)

OTHER PUBLICATIONS

Publication No. 2001/0050503-A1, G. Piretti, Dec. 13, 2001.
Publication No. 2002/0074841-A1, T. Chen, Jun. 20, 2002.

*Primary Examiner* — Anthony D Barfield

(74) *Attorney, Agent, or Firm* — Faegre Drinker Biddle & Reath LLP

(57) ABSTRACT

A chair includes a base and a back coupled to the base. The back includes a pair of back supports extending from the base and a back panel coupled to the pair of back supports. Each back support is configured to exhibit a first bending stiffness when bent to a first stop point, and exhibit a second bending stiffness when bent beyond the first stop point, the second bending stiffness being greater than the first bending stiffness.

7 Claims, 17 Drawing Sheets

(56) References Cited

U.S. PATENT DOCUMENTS

| | | | |
|---|---|---|---|
| 2,030,635 | A | 2/1936 | George et al. |
| 2,059,940 | A | 11/1936 | Freedman |
| 2,071,974 | A | 2/1937 | Gunlocke |
| 2,082,499 | A | 6/1937 | Keyworth |
| 2,083,838 | A | 6/1937 | Goenen |
| 2,191,848 | A | 2/1940 | Cramer et al. |
| 2,218,941 | A | 10/1940 | Thompson |
| 2,228,719 | A | 1/1941 | Bolens |
| 2,235,292 | A | 3/1941 | Glynn |
| D127,281 | S | 5/1941 | Schreckengost |
| 2,283,062 | A | 5/1942 | Herold |
| 2,325,292 | A | 7/1943 | Westrope |
| 2,365,200 | A | 12/1944 | Lorenz |
| 2,374,350 | A | 4/1945 | Herold |
| 2,397,382 | A | 3/1946 | Smith |
| 2,400,588 | A | 5/1946 | McArthur |
| 2,441,251 | A | 5/1948 | Raitch |
| 2,454,912 | A | 11/1948 | Cunningham |
| 2,463,257 | A | 3/1949 | Fox |
| 2,483,223 | A | 9/1949 | Moss |
| 2,491,875 | A | 12/1949 | Grover et al. |
| 2,540,426 | A | 2/1951 | Campbell |
| 2,549,902 | A | 4/1951 | Hibbard et al. |
| 2,577,050 | A | 12/1951 | Van Buren |
| 2,599,301 | A | 6/1952 | Van Buren |
| 2,634,650 | A | 4/1953 | Coop |
| 2,642,126 | A | 6/1953 | Grabendike |
| 2,760,556 | A | 8/1956 | Henrikson et al. |
| 2,760,813 | A | 8/1956 | Colm |
| 2,784,769 | A | 3/1957 | Fisher |
| 2,796,918 | A | 6/1957 | Luckhardt |
| 2,815,067 | A | 12/1957 | Richardson |
| 2,859,799 | A | 11/1958 | Moore |
| 2,965,161 | A | 12/1960 | Knoll |
| 2,999,665 | A | 9/1961 | Albert et al. |
| 3,008,764 | A | 11/1961 | Pile |
| 3,019,051 | A | 1/1962 | Nugent |
| 3,026,145 | A | 3/1962 | Galbraith |
| 3,059,888 | A | 10/1962 | Lie |
| 3,072,436 | A | 1/1963 | Moore |
| 3,086,826 | A | 4/1963 | Gunnell |
| 3,133,765 | A | 5/1964 | Kramer |
| 3,140,118 | A | 7/1964 | Dorn |
| 3,142,194 | A | 7/1964 | Garden |
| 3,145,053 | A | 8/1964 | Thompson et al. |
| 3,146,028 | A | 8/1964 | Grosfillex |
| 3,147,797 | A | 9/1964 | Miner |
| 3,148,855 | A | 9/1964 | Hamilton |
| 3,159,428 | A | 12/1964 | Schier |
| 3,162,484 | A | 12/1964 | Kleffman |
| 3,167,366 | A | 1/1965 | Freund |
| 3,177,036 | A | 4/1965 | Halter |
| 3,182,377 | A | 5/1965 | Hoven et al. |
| 3,215,470 | A | 11/1965 | Swenson et al. |
| 3,223,450 | A | 12/1965 | Pollock |
| 3,235,308 | A | 2/1966 | Lyman |
| 3,250,567 | A | 5/1966 | Parrott |
| 3,258,259 | A | 6/1966 | Bohlin |
| RE26,071 | E | 8/1966 | Rowland |
| 3,271,073 | A | 9/1966 | Buren, Jr. |
| 3,275,371 | A | 9/1966 | Rowland |
| 3,278,227 | A | 10/1966 | Rowland |
| 3,292,972 | A | 12/1966 | Krueger |
| 3,298,743 | A | 1/1967 | Albinson et al. |
| 3,329,463 | A | 7/1967 | Zimmermann |
| 3,339,873 | A | 9/1967 | Hale |
| 3,343,901 | A | 9/1967 | Marcus |
| 3,356,414 | A | 12/1967 | Doerner |
| 3,393,941 | A | 7/1968 | Grosfillex |
| 3,404,916 | A | 10/1968 | Rowland |
| 3,408,106 | A | 10/1968 | Bolling et al. |
| 3,427,054 | A | 2/1969 | Bergman |
| 3,453,024 | A | 7/1969 | Williams |
| 3,474,993 | A | 10/1969 | Murcott |
| 3,476,342 | A | 11/1969 | Motl et al. |
| 3,482,874 | A | 12/1969 | Henebry et al. |
| 3,503,523 | A | 3/1970 | Hamilton et al. |
| 3,521,929 | A | 7/1970 | Pearson |
| 3,547,394 | A | 12/1970 | Wehner |
| 3,578,379 | A | 5/1971 | Taylor et al. |
| 3,583,759 | A | 6/1971 | Kramer |
| 3,594,038 | A | 7/1971 | Polsky et al. |
| 3,598,354 | A | 8/1971 | Williams |
| 3,602,537 | A | 8/1971 | Kerstholt et al. |
| 3,606,234 | A | 9/1971 | Prescott |
| 3,612,607 | A | 10/1971 | Lohr |
| 3,614,156 | A | 10/1971 | Sarvas |
| 3,614,157 | A | 10/1971 | Hendrickson et al. |
| 3,630,566 | A | 12/1971 | Barecki |
| 3,647,260 | A | 3/1972 | Grant et al. |
| 3,669,496 | A | 6/1972 | Chisholm |
| 3,669,499 | A | 6/1972 | Semplonius et al. |
| 3,672,721 | A | 6/1972 | Williams |
| 3,675,970 | A | 7/1972 | Bereday |
| 3,697,130 | A | 10/1972 | Barecki et al. |
| 3,711,156 | A | 1/1973 | Bloomfield |
| 3,747,976 | A | 7/1973 | Lacey |
| 3,762,769 | A | 10/1973 | Poschl |
| 3,778,014 | A | 12/1973 | Beaver et al. |
| 3,788,586 | A | 1/1974 | McNally |
| 3,788,701 | A | 1/1974 | Massaccesi |
| 3,794,382 | A | 2/1974 | Grange et al. |
| 3,820,845 | A | 6/1974 | Persson |
| 3,825,302 | A | 7/1974 | Kurtz |
| 3,826,453 | A | 7/1974 | Hitchcock |
| 3,851,920 | A | 12/1974 | Lannert et al. |
| 3,854,772 | A | 12/1974 | Abrahamson et al. |
| 3,869,172 | A | 3/1975 | James et al. |
| 3,874,727 | A | 4/1975 | Mehbert et al. |
| 3,883,176 | A | 5/1975 | Morton |
| 3,904,242 | A | 9/1975 | Koepke et al. |
| 3,907,363 | A | 9/1975 | Baker et al. |
| 3,947,068 | A | 3/1976 | Buhk |
| 3,982,785 | A | 9/1976 | Ambasz |
| 4,012,158 | A | 3/1977 | Harper |
| 4,013,258 | A | 3/1977 | Doerner |
| 4,014,086 | A | 3/1977 | Doerner |
| 4,018,415 | A | 4/1977 | Wolters |
| 4,032,190 | A | 6/1977 | Muller-Deisig et al. |
| 4,036,525 | A | 7/1977 | Howk |
| 4,043,592 | A | 8/1977 | Fries |
| 4,045,844 | A | 9/1977 | Murray |
| 4,047,757 | A | 9/1977 | Eames et al. |
| 4,099,278 | A | 7/1978 | Parisi |
| 4,099,774 | A | 7/1978 | Sandham |
| 4,102,549 | A | 7/1978 | Morrison et al. |
| 4,123,103 | A | 10/1978 | Doerner |
| 4,123,105 | A | 10/1978 | Frey et al. |
| 4,131,260 | A | 12/1978 | Ambasz |
| 4,131,315 | A | 12/1978 | Vogtherr |
| 4,139,175 | A | 2/1979 | Bauer |
| 4,143,910 | A | 3/1979 | Geffers et al. |
| 4,153,296 | A | 5/1979 | Rhamstine |
| 4,155,592 | A | 5/1979 | Matsuoka et al. |
| 4,159,148 | A | 6/1979 | Schulz |
| 4,159,847 | A | 7/1979 | Arai |
| 4,169,625 | A | 10/1979 | Petersen |
| 4,198,094 | A | 4/1980 | Bjerknes et al. |
| 4,200,332 | A | 4/1980 | Brauning |
| 4,221,430 | A | 9/1980 | Frobose |
| 4,227,102 | A | 10/1980 | Rozenfeld et al. |
| 4,267,748 | A | 5/1981 | Grunewald et al. |
| 4,270,798 | A | 6/1981 | Harder, Jr. |
| 4,277,102 | A | 7/1981 | Aaras et al. |
| 4,282,634 | A | 8/1981 | Krauss |
| D261,831 | S | 11/1981 | Luckey |
| 4,305,617 | A | 12/1981 | Benoit |
| 4,309,058 | A | 1/1982 | Barley |
| 4,318,570 | A | 3/1982 | Adam et al. |
| 4,365,840 | A | 12/1982 | Kehl et al. |
| 4,386,805 | A | 6/1983 | Boisset |
| 4,390,206 | A | 6/1983 | Faiks et al. |
| 4,401,006 | A | 8/1983 | Sekiguchi |
| 4,408,800 | A | 10/1983 | Knapp |

(56) References Cited

U.S. PATENT DOCUMENTS 4,429,917 A 2/1984 Diffrient
4,429,918 A 2/1984 Alsup et al.
4,432,582 A 2/1984 Wiesmann et al.
4,438,978 A 3/1984 Arild
4,451,084 A 5/1984 Seeley
4,451,085 A 5/1984 Franck et al.
4,466,665 A 8/1984 Aronowitz et al.
4,478,454 A 10/1984 Faiks
4,479,679 A 10/1984 Fries et al.
4,489,982 A 12/1984 Morrow
4,500,137 A 2/1985 Morehouse
4,502,729 A 3/1985 Locher
4,509,793 A 4/1985 Wiesmann et al.
4,521,053 A 6/1985 De Boer
D279,443 S 7/1985 Diffrient
4,537,445 A 8/1985 Neuhoff
4,546,668 A 10/1985 Mattsson
4,557,521 A 12/1985 Lange
4,572,578 A 2/1986 Perkins
4,573,737 A 3/1986 Korn
4,576,351 A 3/1986 Brink
4,595,237 A 6/1986 Nelsen
4,597,606 A 7/1986 Magee
4,602,817 A 7/1986 Raftery
4,603,905 A 8/1986 Stucki
4,616,877 A 10/1986 Slaats et al.
4,629,249 A 12/1986 Yamaguchi
4,634,178 A 1/1987 Carney
4,639,039 A 1/1987 Donovan
4,643,480 A 2/1987 Morita
4,647,109 A 3/1987 Christophersen et al.
4,648,654 A 3/1987 Voss
4,659,135 A 4/1987 Johnson
4,660,885 A 4/1987 Suhr et al.
4,660,887 A 4/1987 Fleming et al.
4,662,681 A 5/1987 Favaretto
4,682,814 A 7/1987 Hansen
4,684,173 A 8/1987 Locher
4,685,730 A 8/1987 Linguanotto
4,688,961 A 8/1987 Shioda et al.
4,703,974 A 11/1987 Braeuning
4,707,026 A 11/1987 Johansson
4,707,028 A 11/1987 Gamberini
4,709,962 A 12/1987 Steinmann
4,715,655 A 12/1987 Katsumoto et al.
4,718,725 A 1/1988 Suhr et al.
4,720,068 A 1/1988 Tornero
4,720,142 A 1/1988 Holdredge et al.
4,732,097 A 3/1988 Guilhem
4,744,600 A 5/1988 Inoue
4,744,603 A 5/1988 Knoblock
4,746,168 A 5/1988 Bracesco
4,747,640 A 5/1988 Locher
4,749,230 A 6/1988 Tornero
4,752,101 A 6/1988 Yurchenco et al.
4,754,364 A 6/1988 Speet et al.
4,758,045 A 7/1988 Edel et al.
4,761,033 A 8/1988 Lanuzzi et al.
4,763,950 A 8/1988 Tobler
4,765,679 A 8/1988 Lanuzzi et al.
4,773,706 A 9/1988 Hinrichs
4,776,633 A 10/1988 Knoblock et al.
4,783,121 A 11/1988 Luyk et al.
4,789,203 A 12/1988 van Zee et al.
4,795,211 A 1/1989 Stern et al.
4,796,952 A 1/1989 Piretti
4,818,019 A 4/1989 Mrotz, III
4,828,323 A 5/1989 Brodersen et al.
4,834,453 A 5/1989 Makiol
4,840,426 A 6/1989 Vogtherr et al.
4,848,837 A 7/1989 Volkle
4,856,846 A 8/1989 Lohmeyer
4,871,208 A 10/1989 Hodgdon
4,877,291 A 10/1989 Taylor
4,881,424 A 11/1989 Clark et al.
4,883,319 A 11/1989 Scott
4,889,385 A 12/1989 Chadwick et al.
4,892,356 A 1/1990 Pittman et al.
4,906,045 A 3/1990 Hofman
4,907,835 A 3/1990 Salters
4,908,917 A 3/1990 Kazle
4,917,438 A 4/1990 Morgan
4,930,840 A 6/1990 Tornero
4,938,532 A 7/1990 Burgess
4,940,202 A 7/1990 Hosan et al.
4,943,115 A 7/1990 Stucki
4,961,610 A 10/1990 Reeder et al.
4,962,962 A 10/1990 Machate et al.
4,966,411 A 10/1990 Katagiri et al.
4,966,412 A 10/1990 Dauphin
4,979,778 A 12/1990 Shields
4,986,601 A 1/1991 Inoue
5,007,678 A 4/1991 DeKraker
5,009,467 A 4/1991 McCoy
5,015,038 A 5/1991 Mrotz, III
5,026,117 A 6/1991 Faiks et al.
5,029,822 A 7/1991 Selzer
5,035,466 A 7/1991 Mathews et al.
5,035,494 A 7/1991 Foldenauer
5,037,158 A 8/1991 Crawford
5,046,780 A 9/1991 Decker et al.
5,064,247 A 11/1991 Clark et al.
5,067,772 A 11/1991 Koa
5,074,620 A 12/1991 Jay et al.
5,102,196 A 4/1992 Kaneda et al.
5,104,190 A 4/1992 Siegrist
5,110,186 A 5/1992 Clark et al.
5,131,718 A 7/1992 Cooper
5,143,422 A 9/1992 Althofer et al.
5,181,764 A 1/1993 Wiener
5,201,108 A 4/1993 Clark et al.
5,232,265 A 8/1993 Estkowski et al.
5,234,251 A 8/1993 Ayotte
5,249,839 A 10/1993 Faiks et al.
5,251,958 A 10/1993 Roericht et al.
5,290,087 A 3/1994 Spykerman
5,295,731 A 3/1994 Dauphin
5,303,980 A 4/1994 Young
5,308,145 A 5/1994 Koepke et al.
5,314,237 A 5/1994 Koepke et al.
5,314,240 A 5/1994 Ishi et al.
5,318,345 A 6/1994 Olson
5,318,346 A 6/1994 Roossien et al.
5,318,347 A 6/1994 Tseng
5,324,096 A 6/1994 Schultz
5,338,092 A 8/1994 Wiltsey et al.
5,340,195 A 8/1994 Notta
5,352,022 A 10/1994 Knoblock
5,366,274 A 11/1994 Roericht et al.
5,370,444 A 12/1994 Stulik
5,382,079 A 1/1995 Wilson et al.
5,390,978 A 2/1995 Janisch
5,393,124 A 2/1995 Neil
5,398,993 A 3/1995 Chen
5,405,189 A 4/1995 Stumpf
5,407,249 A 4/1995 Bonutti
5,415,459 A 5/1995 Schultz
5,417,473 A 5/1995 Brauning
5,419,617 A 5/1995 Schultz
5,425,566 A 6/1995 Buchacz
5,427,434 A 6/1995 Hybarger
5,439,267 A 8/1995 Peterson et al.
5,462,339 A 10/1995 Schmale et al.
5,478,137 A 12/1995 Olson et al.
5,486,035 A 1/1996 Koepke et al.
5,486,036 A 1/1996 Ito et al.
5,497,966 A 3/1996 Fuhrmann
5,507,559 A 4/1996 Lance
5,507,563 A 4/1996 Arthur, Jr.
5,529,373 A 6/1996 Olson et al.
5,540,481 A 7/1996 Roossien et al.
5,542,159 A 8/1996 Schultz et al.
5,542,743 A 8/1996 Olson et al.
5,547,252 A 8/1996 Pfenniger

(56) References Cited

U.S. PATENT DOCUMENTS

| | | | |
|---|---|---|---|
| 5,556,163 | A | 9/1996 | Rogers et al. |
| 5,564,783 | A | 10/1996 | Elzenbeck et al. |
| 5,567,012 | A | 10/1996 | Knoblock |
| 5,575,534 | A | 11/1996 | Yu |
| 5,577,807 | A | 11/1996 | Hodge et al. |
| 5,577,811 | A | 11/1996 | Ogg |
| 5,582,460 | A | 12/1996 | Schultz |
| 5,590,934 | A | 1/1997 | Gibbs |
| 5,601,338 | A | 2/1997 | Wahls |
| 5,607,204 | A | 3/1997 | Gryp |
| 5,630,643 | A | 5/1997 | Scholten et al. |
| 5,630,649 | A | 5/1997 | Heidmann et al. |
| 5,641,203 | A | 6/1997 | Van De Riet et al. |
| 5,647,638 | A | 7/1997 | Ritt et al. |
| 5,655,814 | A | 8/1997 | Gibbs |
| 5,658,045 | A | 8/1997 | Van et al. |
| 5,660,439 | A | 8/1997 | Unwalla |
| 5,662,381 | A | 9/1997 | Roossien et al. |
| 5,664,834 | A | 9/1997 | Hsu |
| 5,683,139 | A | 11/1997 | Golynsky et al. |
| 5,685,609 | A | 11/1997 | Miotto |
| 5,704,691 | A | 1/1998 | Olson |
| 5,711,576 | A | 1/1998 | Olson et al. |
| 5,716,101 | A | 2/1998 | Frinier et al. |
| 5,725,278 | A | 3/1998 | Verbeek |
| 5,738,318 | A | 4/1998 | Thole et al. |
| 5,749,628 | A | 5/1998 | Synder et al. |
| 5,755,488 | A | 5/1998 | Beda et al. |
| 5,755,490 | A | 5/1998 | Lamart |
| 5,762,399 | A | 6/1998 | Liu |
| 5,762,403 | A | 6/1998 | Robinson |
| 5,765,804 | A | 6/1998 | Stumpf et al. |
| 5,765,914 | A | 6/1998 | Britain et al. |
| 5,772,282 | A | 6/1998 | Stumpf et al. |
| 5,775,774 | A | 7/1998 | Okano |
| 5,782,536 | A | 7/1998 | Heidmann et al. |
| 5,791,734 | A | 8/1998 | Malenotti |
| 5,795,116 | A | 8/1998 | Frank et al. |
| 5,797,652 | A | 8/1998 | Darbyshire |
| 5,810,439 | A | 9/1998 | Roslund, Jr. |
| 5,820,218 | A | 10/1998 | Baloche et al. |
| 5,823,625 | A | 10/1998 | Holmes |
| 5,826,940 | A | 10/1998 | Hodgdon |
| 5,836,648 | A | 11/1998 | Karschin et al. |
| 5,848,823 | A | 12/1998 | Su |
| 5,853,222 | A | 12/1998 | Roslund et al. |
| 5,853,223 | A | 12/1998 | Ritt et al. |
| 5,860,701 | A | 1/1999 | Jungjohann et al. |
| 5,871,258 | A | 2/1999 | Battey et al. |
| 5,873,634 | A | 2/1999 | Heidmann et al. |
| 5,884,976 | A | 3/1999 | Breen et al. |
| 5,895,095 | A | 4/1999 | Chen |
| 5,904,459 | A | 5/1999 | Prathap et al. |
| 5,908,221 | A | 6/1999 | Neil |
| 5,909,923 | A | 6/1999 | DeKraker |
| 5,931,536 | A | 8/1999 | Wu |
| 5,934,758 | A | 8/1999 | Ritch et al. |
| 5,938,285 | A | 8/1999 | Verbeek |
| 5,944,386 | A | 8/1999 | Yamagishi et al. |
| 5,971,484 | A | 10/1999 | Lamart et al. |
| 5,975,632 | A | 11/1999 | Ginat |
| 5,975,634 | A | 11/1999 | Knoblock et al. |
| 5,979,984 | A | 11/1999 | Dekraker et al. |
| 5,979,988 | A | 11/1999 | Heidmann et al. |
| 6,027,129 | A | 2/2000 | Kleinschmit et al. |
| 6,027,168 | A | 2/2000 | Crossman et al. |
| 6,027,169 | A | 2/2000 | Roslund, Jr. |
| 6,035,901 | A | 3/2000 | Stumpf et al. |
| 6,045,191 | A | 4/2000 | Piretti |
| 6,050,646 | A | 4/2000 | Stenzel et al. |
| 6,053,578 | A | 4/2000 | van Hekken et al. |
| 6,059,368 | A | 5/2000 | Stumpf et al. |
| 6,062,649 | A | 5/2000 | Nagel et al. |
| 6,070,774 | A | 6/2000 | Rak et al. |
| 6,070,937 | A | 6/2000 | Ginat |
| 6,076,891 | A | 6/2000 | Bernhardt |
| 6,076,892 | A | 6/2000 | van Hekken et al. |
| 6,079,786 | A | 6/2000 | Kirkland et al. |
| 6,086,153 | A | 7/2000 | Heidmann et al. |
| 6,099,076 | A | 8/2000 | Nagel et al. |
| 6,102,477 | A | 8/2000 | Kurtz |
| 6,106,070 | A | 8/2000 | Ritt et al. |
| 6,109,694 | A | 8/2000 | Kurtz |
| 6,116,695 | A | 9/2000 | Heidmann et al. |
| 6,125,521 | A | 10/2000 | Stumpf et al. |
| 6,135,556 | A | 10/2000 | Chu et al. |
| 6,155,645 | A | 12/2000 | Bedrich |
| 6,161,897 | A | 12/2000 | Kurtz et al. |
| 6,179,384 | B1 | 1/2001 | Dekraker et al. |
| 6,193,313 | B1 | 2/2001 | Jonsson |
| 6,193,314 | B1 | 2/2001 | Chiang |
| 6,199,952 | B1 | 3/2001 | Davis |
| 6,203,107 | B1 | 3/2001 | Jonsson |
| 6,224,160 | B1 | 5/2001 | Takeuchi et al. |
| D443,425 | S | 6/2001 | Pomeroy et al. |
| 6,254,190 | B1 | 7/2001 | Gregory |
| 6,296,309 | B1 | 10/2001 | Kurtz |
| 6,296,312 | B1 | 10/2001 | Congleton et al. |
| 6,299,253 | B1 | 10/2001 | Chen |
| 6,305,747 | B1 | 10/2001 | Mei |
| 6,345,864 | B1 | 2/2002 | Rivera et al. |
| 6,361,117 | B1 | 3/2002 | Tate |
| 6,367,876 | B2 | 4/2002 | Caruso et al. |
| 6,382,719 | B1 | 5/2002 | Heidmann et al. |
| 6,382,723 | B1 | 5/2002 | Piretti |
| 6,402,245 | B1 | 6/2002 | Newton et al. |
| 6,439,661 | B1 | 8/2002 | Brauning |
| 6,513,222 | B2 | 2/2003 | Von Ehr et al. |
| 6,517,161 | B2 | 2/2003 | Lo |
| 6,540,950 | B1 | 4/2003 | Coffield |
| 6,550,866 | B1 | 4/2003 | Su |
| 6,568,760 | B2 | 5/2003 | Davis et al. |
| 6,572,190 | B2 | 6/2003 | Koepke et al. |
| 6,609,755 | B2 | 8/2003 | Koepke et al. |
| 6,616,231 | B2 | 9/2003 | Koepke et al. |
| 6,634,711 | B2 | 10/2003 | Phillips et al. |
| 6,669,292 | B2 | 12/2003 | Koepke et al. |
| 6,688,692 | B2 | 2/2004 | Phillips et al. |
| 6,702,386 | B2 | 3/2004 | Davis et al. |
| 6,729,691 | B2 | 5/2004 | Koepke et al. |
| 6,773,072 | B2 | 8/2004 | Phillips et al. |
| 6,793,286 | B2 | 9/2004 | Burgin |
| 6,824,215 | B2 | 11/2004 | Koepke et al. |
| 7,686,395 | B2 | 3/2010 | Piretti |
| 7,862,120 | B2 | 1/2011 | Ueda |
| 2001/0050503 | A1 | 12/2001 | Piretti |
| 2002/0074841 | A1 | 6/2002 | Chen |
| 2002/0190558 | A1 | 12/2002 | Phillips et al. |
| 2002/0190559 | A1 | 12/2002 | Phillips et al. |
| 2003/0067200 | A1 | 4/2003 | Habermann et al. |
| 2004/0113471 | A1* | 6/2004 | Rivera ..... A47C 7/445 297/258.1 |
| 2006/0202534 | A1 | 9/2006 | Heidmann et al. |
| 2014/0183915 | A1 | 7/2014 | Deisig et al. |
| 2019/0045934 | A1* | 2/2019 | Deisig ..... A47C 7/44 |
| 2020/0229605 | A1 | 7/2020 | Machael et al. |
| 2021/0345781 | A1* | 11/2021 | Ludwig ..... A47C 7/16 |

FOREIGN PATENT DOCUMENTS

| | | | | |
|---|---|---|---|---|
| DE | 2850654 | A1 | 5/1979 | |
| DE | 2932134 | A1 | 2/1981 | |
| DE | 3116459 | A1 | 11/1982 | |
| DE | 3800751 | A1 | 8/1988 | |
| DE | 4216358 | A1 | 11/1992 | |
| DE | 202012008088 | U1 * | 1/2013 | ..... A47C 3/023 |
| EP | 0237825 | A2 | 9/1987 | |
| EP | 0242140 | A2 | 10/1987 | |
| EP | 0247311 | B1 | 3/1991 | |
| EP | 2887836 | B1 * | 7/2016 | ..... A47C 3/023 |
| FR | 0654651 | A | 4/1929 | |
| FR | 2505158 | A1 | 11/1982 | |
| GB | 0993449 | A | 5/1965 | |
| GB | 2011253 | A | 7/1979 | |

(56) References Cited

FOREIGN PATENT DOCUMENTS

| | | | |
|---|---|---|---|
| GB | 2041735 | A | 9/1980 |
| GB | 2060367 | A | 5/1981 |
| JP | 01-060465 | A | 3/1989 |
| SE | 196030 | | 5/1965 |

* cited by examiner

CHAIRS INCLUDING FLEXIBLE FRAMES

CROSS-REFERENCE TO RELATED APPLICATION

This application claims priority to and is a divisional of U.S. patent application Ser. No. 16/745,120, filed Jan. 16, 2020, now U.S. Pat. No. 11,589,678, which claims priority to Provisional Application No. 62/793,729, filed Jan. 17, 2019, which are herein incorporated by reference in their entirety.

TECHNICAL FIELD

The present invention relates to chairs including back and/or seating surfaces that adjust the position of an occupant's body.

BACKGROUND

Chairs may have some ability to adjust to an occupant's body as they adjust their position in the chair, such as when changing postures, stretching, or various office tasks done while seated. For example, some chair designs include some flexibility in the top edge of the back to alleviate pressure where the edge contacts the occupant's back during recline. Some chair designs include some flexibility of the sides of the back. However, such back designs flex with a relatively uniform stiffness, resulting in the occupant not having any indication when the maximum safe deflection has been reached. This my give rise to a disconcerting feeling of impending failure.

Some chair designs include some flexibility in the front edge of the seat to alleviate pressure under the occupant's knees during recline and when changing postures. Such designs typically have a plastic seat support surface which is shaped to reduce the stiffness locally near the front edge of the seat. This can be done by thinning support ribs near the front edge. Other designs create perforations in the seat support surface near the front edge to reduce the stiffness locally near the front edge of the seat. However, such seat designs effectively shorten the seat depth, resulting in an increase in overall pressure. This increase in pressure is still felt under the occupant's knees, just further back along the legs.

A more general problem with these chair designs is inability to flex easily enough to decreases pressure and allow movement, and still be strong enough to safely support an occupant.

SUMMARY

Various aspects of this disclosure relate to features for providing a chair including one or more back supports that exhibit a first bending stiffness when bent to a stop point, and exhibit a second bending stiffness when bent beyond the stop point, the second bending stiffness being greater than the first bending stiffness.

According to one example ("Example 1"), a chair includes a base and a back coupled to the base. The back includes a pair of back supports extending from the base and a back panel coupled to the pair of back supports. Each back support is configured to exhibit a first bending stiffness when bent to a first stop point, and exhibit a second bending stiffness when bent beyond the first stop point, the second bending stiffness being greater than the first bending stiffness.

According to another example ("Example 2") further to Example 1, each of the back supports includes a first bar, a second bar, and a first stop device. The first bar includes a first end and a second end opposite the first end. The first end is fixed to the base. The second bar includes a third end and a fourth end opposite the third end. The third end is disposed adjacent to the base and movable relative to the base. The third end is spaced apart from the first end. The fourth end is fixed to the first bar between the first end and the second end. The first stop device acts between the second bar and the base to determine the first stop point by limiting an extent of movement of the second bar relative to the base.

According to another example ("Example 3") further to Example 2, the first stop device includes a first hole or cavity formed in the base, the first hole or cavity sized to permit unrestricted passage of the second bar, and a first stop element fixed to and projecting from the second bar, the first stop element sized to prohibit passage into the first hole or cavity, the first stop element disposed between the fourth end and the base, and spaced apart from the base by a first gap to determine the first stop point at which the first stop element limits the passage of the second bar into the first hole or cavity as the back support is bent.

According to another example ("Example 4") further to Example 3, the first stop element is spaced apart from the base by a first gap of from 0.025 inches to 0.5 inches when the back support is unbent.

According to another example ("Example 5") further to Example 3, each back support is further configured to independently exhibit a third bending stiffness when bent to a second stop point, the third bending stiffness being greater than the second bending stiffness.

According to another example ("Example 6") further to Example 5, the chair further includes a third bar including a fifth end and a sixth end opposite the fifth end, the fifth end disposed adjacent to the base and movable relative to the base, the fifth end spaced apart from the third end on an opposite side of the second bar from the first bar, the sixth end fixed to the first bar between the fourth end and the second end; and a second stop device acting between the third bar and the base to determine the second stop point by limiting an extent of movement of the third bar relative to the base.

According to another example ("Example 7") further to Example 6, the hole or cavity is a first hole or cavity and the second stop device includes a second hole or cavity formed in a surface of the base, the second hole or cavity sized to permit unrestricted passage of the third bar; and a second stop element fixed to and projecting from third bar, the second stop element sized to prohibit passage into the second hole or cavity, the second stop element disposed between the sixth end and the base and spaced from the sixth end to determine the second stop point at which the second stop element limits the passage of the third bar into the second hole or cavity as the back support is bent.

According to another example ("Example 8") further to Example 3, the second stop element is spaced apart from the base by a second gap of from 0.025 inches to 0.5 inches greater than the first gap when the back support is unbent.

According to another example ("Example 9") further to Example 1, each of the back supports includes a first bar, a second bar, and a stop device. The first bar includes a first end and a second end opposite the first end, the first end disposed adjacent to the base and moveable relative to the base. The second bar includes a third end and a fourth end opposite the third end, the third end fixed to the base apart from the first end, the fourth end fixed to the first bar between the first end and the second end. The stop device acts between the first end and the base to determine the first stop point by limiting the extent of movement of the first end relative to the base.

According to another example ("Example 10") further to Example 9, the stop device includes a hole formed through the first bar at the first end and a stop element projecting from the base, the stop element including a head and a shaft connecting the head to the base, the shaft extending through the hole, the hole sized to permit limited movement of the first end relative to the base in a vertical direction to determine the first stop point, the head sized to prevent the first bar from disengaging from the shaft.

According to another example ("Example 11") further to Example 10, the hole sized is sized to provide a gap between the shaft and the first bar on one side of the shaft when an opposite side of the shaft is in contact with the first bar of from 0.025 inches to 0.5 inches when the back support is unbent.

According to another example ("Example 12") further to Example 1, each of the back supports includes a first bar, a second bar, and a first stop device. The first bar includes a first end and a second end opposite the first end, the first end fixed to the base. The second bar includes a third end and a fourth end opposite the third end, the third end fixed to the base, the third end spaced apart from the first end, the fourth end disposed adjacent to the first bar between the first end and the second end, the fourth end in sliding engagement with the first bar. The first stop device acts between the fourth end and the first bar to determine the first stop point by limiting an extent of the sliding engagement of the fourth end with the first bar.

According to another example ("Example 13") further to Example 12, the first stop device projects from the first bar, the first stop device is disposed along the first bar to determine the first stop point such that the first stop device limits the sliding engagement of the fourth end along the first bar as the back support is bent enough to bring the fourth end into contact with the first stop device.

According to another example ("Example 14") further to Example 13, the first stop device is spaced apart from the fourth end by a first gap of from 0.025 inches to 0.5 inches when the back support is unbent.

According to another example ("Example 15") further to Example 13, each back support is further configured to independently exhibit a third bending stiffness when bent to a second stop point, the third bending stiffness being greater than the second bending stiffness.

According to another example ("Example 16") further to Example 15, the chair further includes a third bar including a fifth end and a sixth end opposite the fifth end, the fifth end fixed to the base, the fifth end spaced apart from the third end on an opposite side of the second bar from the first bar, the sixth end disposed adjacent to the first bar between the first stop device and the second end, the sixth end in sliding engagement with the first bar; and a second stop device acting between the sixth end and the first bar to determine the second stop point by limiting an extent of sliding engagement of the sixth end with the first bar.

According to another example ("Example 17") further to Example 16, the second stop device projects from the first bar, the second stop device disposed along the first bar to determine the second stop point such that the second stop device limits the sliding engagement of the sixth end along the first bar as the back support is bent enough to bring the sixth end into contact with the second stop device.

According to another example ("Example 18") further to Example 17, the second stop device is spaced apart from the sixth end by a second gap of from 0.025 inches to 0.5 inches greater than the first gap when the back support is unbent.

According to another example ("Example 19") further to Example 1, the chair further includes a seat coupled to the base, the seat including a pair of seat supports and a seat support surface coupled to the pair of seat supports. The pair of seat supports extend from the base, each of the seat supports configured to independently exhibit a third bending stiffness when bent to a stop point, and exhibit a fourth bending stiffness when bent beyond the stop point, the fourth bending stiffness being greater than the third bending stiffness.

According to another example ("Example 20"), a chair includes a base and a seat coupled to the base. The seat includes a pair of seat supports and a seat support surface coupled to the pair of seat supports. The seat supports extend from the base, each of the seat supports configured to independently exhibit a first bending stiffness when bent to a stop point, and exhibit a second bending stiffness when bent beyond the stop point, the second bending stiffness being greater than the first bending stiffness.

According to another example ("Example 21") further to Example 29, each of the seat supports includes a first bar, a second bar, and a stop device. The first bar includes a first end and a second end opposite the first end, the first end fixed to the base. The second bar includes a third end and a fourth end opposite the third end, the third end disposed adjacent to the base and movable relative to the base, the third end spaced apart from the first end, the fourth end fixed to the first bar between the first end and the second end. The stop device acts between the second bar and the base to determine the stop point by limiting an extent of movement of the second bar relative to the base.

According to another example ("Example 22") further to Example 21, the stop device includes a hole or cavity formed in a surface of the base, the hole or cavity sized to permit unrestricted passage of the second bar; and a stop element fixed to and projecting from the second bar, the stop element sized to prohibit passage into the hole or cavity, the stop element disposed between the fourth end and the base, and spaced apart from the base by a gap to determine the stop point at which the stop element limits the passage of the second bar into the hole or cavity as the seat support is bent.

According to another example ("Example 23") further to Example 22, the stop element is spaced apart from the base by a gap of from 0.025 inches to 0.5 inches when the seat support is unbent.

According to another example ("Example 24") further to Example 20, each of the seat supports includes a first bar, a second bar, and a stop device. The first bar includes a first end and a second end opposite the first end, the first end disposed adjacent to the base and moveable relative to the base. The second bar includes a third end and a fourth end opposite the third end, the third end fixed to the base apart from the first end, the fourth end fixed to the first bar between the first end and the second end. The stop device acts between the first bar and the base to determine the first stop point by limiting the extent of movement of the first end relative to the base.

According to another example ("Example 25") further to Example 24, the stop device includes a hole formed in a surface of the base, the hole sized to permit unrestricted passage of the first bar; and a stop element projecting from the first bar, the stop element sized to prohibit passage into the hole, the stop element disposed between the first end and the base, and spaced from the first end to determine the stop point at which the stop element limits the passage of the first bar through the hole as the seat support is bent.

According to another example ("Example 26") further to Example 25, the stop element is spaced apart from the base by a gap of from 0.025 inches to 0.5 inches when the seat support is unbent.

According to another example ("Example 27") further to Example 20, each of the seat supports includes a first bar, a second bar, and a stop device. The first bar includes a first end and a second end opposite the first end, the first end fixed to the base. The second bar includes a third end and a fourth end opposite the third end, the third end fixed to the base, the third end spaced apart from the first end, the fourth end disposed adjacent to the first bar between the first end and the second end, the fourth end in sliding engagement with a surface of the first bar. The stop device acts between the fourth end and the first bar to determine the stop point by limiting an extent of sliding engagement of the fourth end with the first bar.

According to another example ("Example 28") further to Example 27, the stop device includes a stop element projecting from the first bar, the stop element disposed along the first bar to determine the stop point such that the stop element limits the sliding engagement of the fourth end along the first bar as the seat support is bent enough to bring the fourth end into contact with the first stop element.

According to another example ("Example 29") further to Example 28, the stop element is spaced apart from the fourth end by a first gap of from 0.025 inches to 0.5 inches when the seat support is unbent.

According to another example ("Example 30") further to Example 20, the chair further includes a back coupled to the base. The back includes a pair of back supports and a back panel coupled to the pair of back supports. The pair of back supports extends from the base, each back support configured to independently exhibit a first bending stiffness when bent to a first stop point, and exhibit a second bending stiffness when bent beyond the first stop point, the second bending stiffness being greater than the first bending stiffness.

The foregoing Examples are just that, and should not be read to limit or otherwise narrow the scope of any of the inventive concepts otherwise provided by the instant disclosure.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

The accompanying drawings are included to provide a further understanding of the disclosure and are incorporated in and constitute a part of this specification, illustrate embodiments, and together with the description serve to explain the principles of the disclosure

Figure 1:
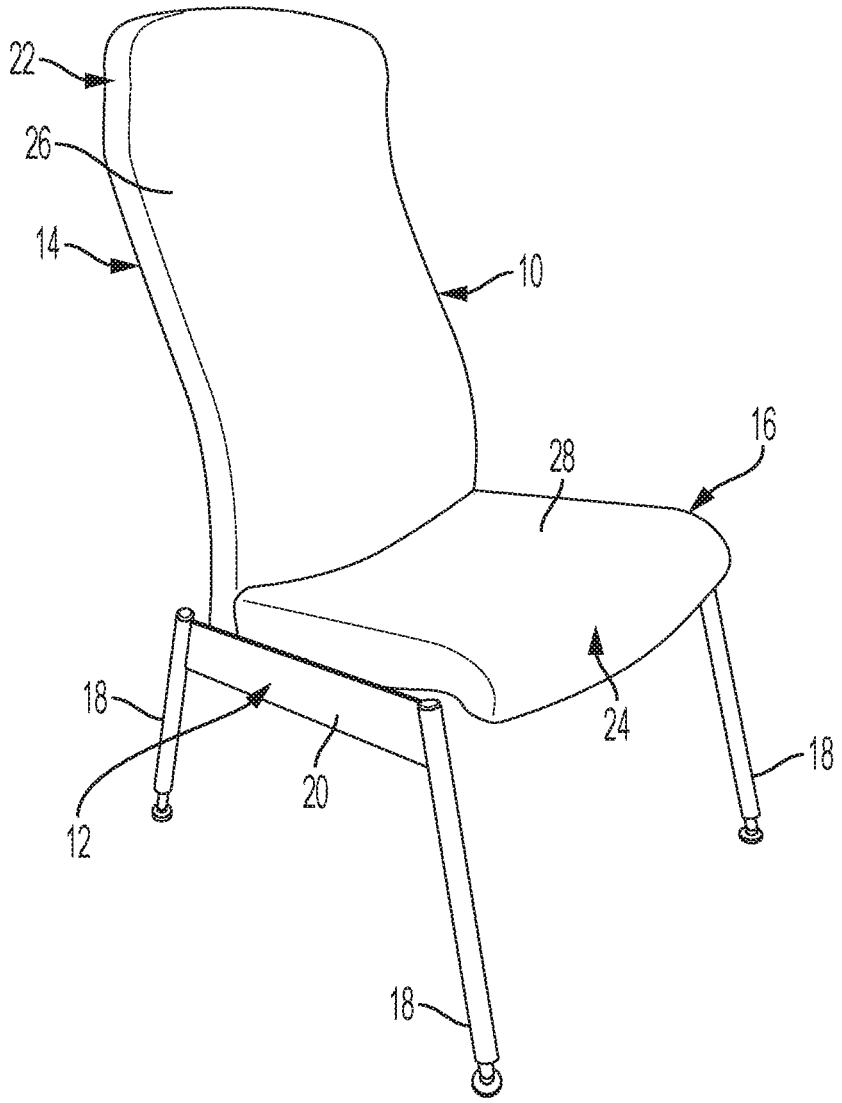
FIG. 1 is a perspective view of a chair, according to some embodiments of this disclosure.

Persons skilled in the art will readily appreciate that various aspects of the present disclosure can be realized by any number of methods and apparatus configured to perform the intended functions. It should also be noted that the accompanying drawing figures referred to herein are not necessarily drawn to scale, but may be exaggerated to illustrate various aspects of the present disclosure, and in that regard, the drawing figures should not be construed as limiting.

DETAILED DESCRIPTION

Some inventive concepts provided by this disclosure relate to chairs including improved flexible back supports and/or improved flexible seat supports. These inventive concepts are examples only, and further inventive concepts, as well as their advantages and associated functions will be appreciated from this disclosure.

This disclosure is not meant to be read in a restrictive manner. For example, the terminology used in the application should be read broadly in the context of the meaning those in the field would attribute such terminology.

With respect terminology of inexactitude, the terms "about" and "approximately" may be used, interchangeably, to refer to a measurement that includes the stated measurement and that also includes any measurements that are reasonably close to the stated measurement. Measurements that are reasonably close to the stated measurement deviate from the stated measurement by a reasonably small amount as understood and readily ascertained by individuals having ordinary skill in the relevant arts. Such deviations may be attributable to measurement error or minor adjustments made to optimize performance, for example. In the event it is determined that individuals having ordinary skill in the relevant arts would not readily ascertain values for such reasonably small differences, the terms "about" and "approximately" can be understood to mean plus or minus 10% of the stated value.

Certain terminology is used herein for convenience only. For example, words such as "top", "bottom", "upper," "lower," "left," "right," "horizontal," "vertical," "upward," and "downward" merely describe the configuration shown in the figures or the orientation of a part in the installed position. Indeed, the referenced components may be oriented in any direction. Similarly, throughout this disclosure, where a process or method is shown or described, the method may be performed in any order or simultaneously, unless it is clear from the context that the method depends on certain actions being performed first.

As used herein, the phrase "within any range defined between any two of the foregoing values" literally means that any range may be selected from any two of the values listed prior to such phrase regardless of whether the values are in the lower part of the listing or in the higher part of the listing. For example, a pair of values may be selected from two lower values, two higher values, or a lower value and a higher value.

FIG. 1 is a perspective view of a chair 10, according to some embodiments of this disclosure. As shown in FIG. 1, chair 10 may include a base 12, a back 14 and a seat 16. The base 12 shown in FIG. 1 includes four fixed legs 18 (three visible in FIG. 1) coupled to a base support 20. In other embodiments (not shown), the base 12 may instead include legs with casters, legs that swivel relative to the base support, and/or legs that branch out from a central axis in a star-shaped pattern of four or more legs. The base 12 may be formed of one or more materials sufficiently sturdy to safely carry an occupant of the chair. Such materials may include metals, polymers, composite materials, or combinations thereof, for example.

The back 14 may include a back panel 22. The seat 16 may include a seat support surface 24. The back 14 and the seat 16 are each individually coupled to the base 12, as described below in reference to FIG. 2. The back panel 22 may include a back cover 26 formed of fabric, leather, one or more polymers, or combinations thereof, or other materials suitable for covering a chair back, as are known in the art. Similarly, the seat support surface 24 may include a seat cover 28 formed of fabric, leather, one or more polymers, or combinations thereof, or other materials suitable for covering a chair seat. In another embodiment, the back 14 and the seat 16 may be a one-piece shell made of any of the above-mentioned materials.

Figure 2:
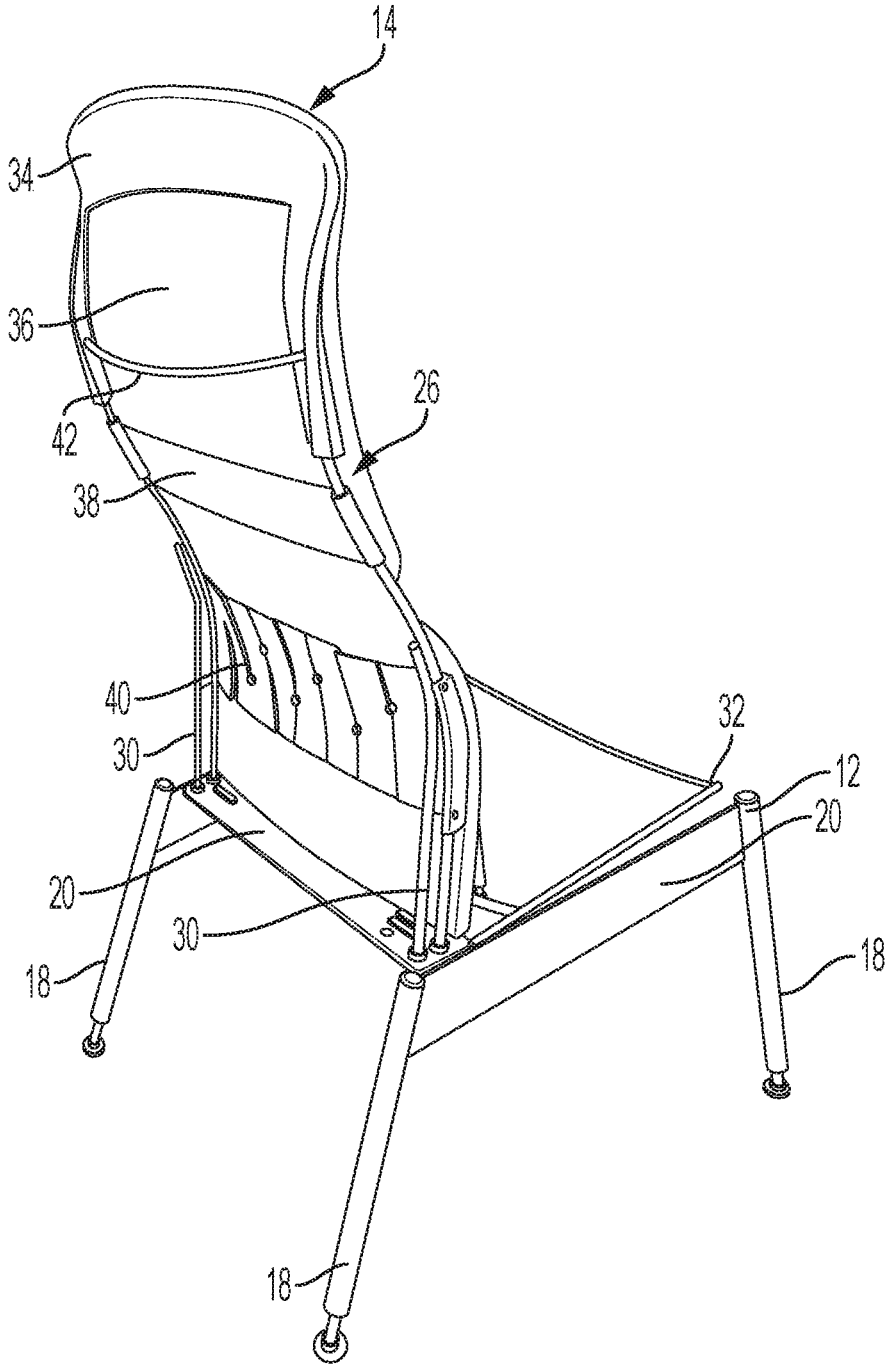
FIG. 2 is a rear perspective view of the chair of FIG. 1, according to some embodiments of this disclosure.

FIG. 2 is a rear perspective view of the chair 10 of FIG. 1, according to some embodiments of this disclosure. In FIG. 2, the back cover 26 and the seat support surface 24 are removed to show additional features of the chair 10. As shown in FIG. 2, the back 14 further includes a pair of back supports 30 and the seat 16 further includes a pair of seat supports 32 (one shown in FIG. 2). The back panel 22 is coupled to the pair of back supports 30. The back panel 22 may further include a shell 34, a foam pad 36, a mesh panel 38, a flexible panel 40, and a back cross-brace 42. The pair of back supports 30 and the pair of seat supports 32 may be independently formed of one or more sturdy materials, including metals, polymers, composites, or combinations thereof. The shell 34 may be formed of a rigid polymer. The foam pad 36 may be formed a polymer foam, such as a polyurethane foam, for example. The mesh panel 38 may be formed of a fabric, a woven polymer, or a knit polymer. The flexible panel 40 may be formed of a flexible polymer, such as a thermoplastic elastomer, for example. The back cross-brace 42 may be formed of any suitable material, such as a metal or a polymer. Although the embodiment of FIG. 2 is shown with the pair of back supports 30, it is understood that the disclosure includes embodiments having a single back support 30.

The pair of back supports 30 may extend generally upward from the base support 20 of the base 12. The shell 34, mesh panel 38, and flexible panel 40 may couple to, and extend between, each of the back supports 30. The foam pad 36 may couple to the shell 34 and the flexible panel 40. The back cross-brace 42 may be connected in a fixed manner, such as by welding, or by an adhesive, for example. Alternatively, or additionally, the back-cross-brace 42 may be connected in a flexible manner, such as by an elastomer joint, or by a revolute joint or other mechanical joint. The back cover 26 (FIG. 1) may cover at least part of the back supports 30, the shell 34, the foam pad, the mesh panel 38, the flexible panel 40, and the back cross-brace 42 to form the back panel 22. Together, the pair of back supports 30 and the back panel 22 may provide a comfortable, flexibly supported back 14, as described further below in reference to FIGS. 4-15C.

In the embodiment shown in FIG. 2, many of the components of the back 14 are visible. In other embodiments, a rear back covering (not shown) may conceal these components from view. For example, in some embodiments, the back cover 26 may be extended to cover both the front of the back 14 and the rear of the back 14.

Figure 3:
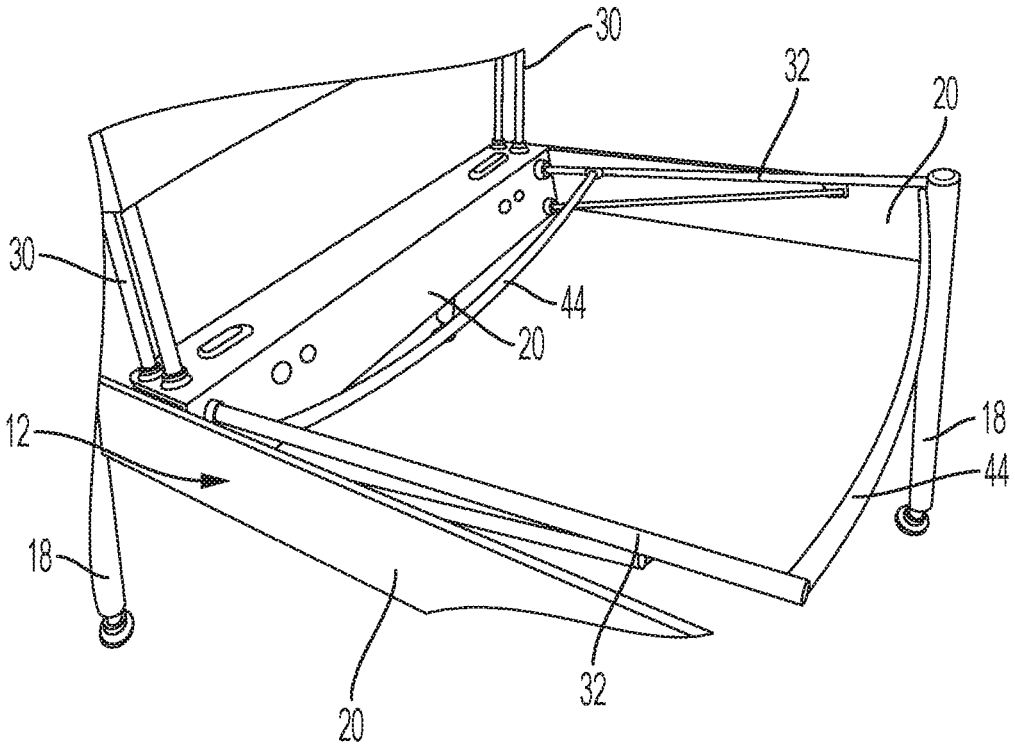
FIG. 3 is a lower front perspective view of the chair of FIG. 1, according to some embodiments of this disclosure.

FIG. 3 is a lower front perspective view of the chair 10 of FIG. 1, according to some embodiments of this disclosure. In FIG. 3, the back cover 26 and the seat support surface 24 are removed to show additional features of the chair 10. The seat support surface 24 (FIG. 1) is coupled to the pair of seat supports 32. Although not shown in FIG. 3, the seat support surface 24 may be constructed similarly to the back panel 22, including any one of a shell, a foam pad, a mesh panel, a flexible panel, or any combination thereof, in addition to the seat cover 28. The seat cover 28 may cover at least part of the seat supports 32, the shell, the foam pad, the mesh panel, and/or the flexible panel.

As shown in FIG. 3, the pair of seat supports 32 may extend generally forward from the base support 20 of the base 12. The seat 16 may further include one or more seat cross-braces 44 (two shown in FIG. 3). The seat cross-braces 44 may be formed of one or more sturdy materials, including metals, polymers, composites, or combinations thereof. In the embodiment shown in FIG. 3, the seat cross-braces are coupled to, and extend between, each of the pair of seat supports 44. The seat cross-braces 44 may be coupled to the seat supports 32 in a fixed arrangement by welds, solders, brazes, adhesives, or mechanical fasteners, or in a flexible arrangement, such as by an elastomer joint, or by a revolute joint or other mechanical joint, or any combination thereof, as are known in art. The seat cross-braces 44 may serve to provide lateral support to the pair of seat supports 32. Together, the pair of seat supports 32, the seat support surface 24, and, optionally, the seat cross-braces 44 may provide a comfortable, flexibly supported seat 16, as described further below in reference to FIGS. 16-22B. Although the embodiment of FIG. 3 is shown with the pair of seat supports 32, it is understood that the disclosure includes embodiments having a single seat support 32.

Figure 4:
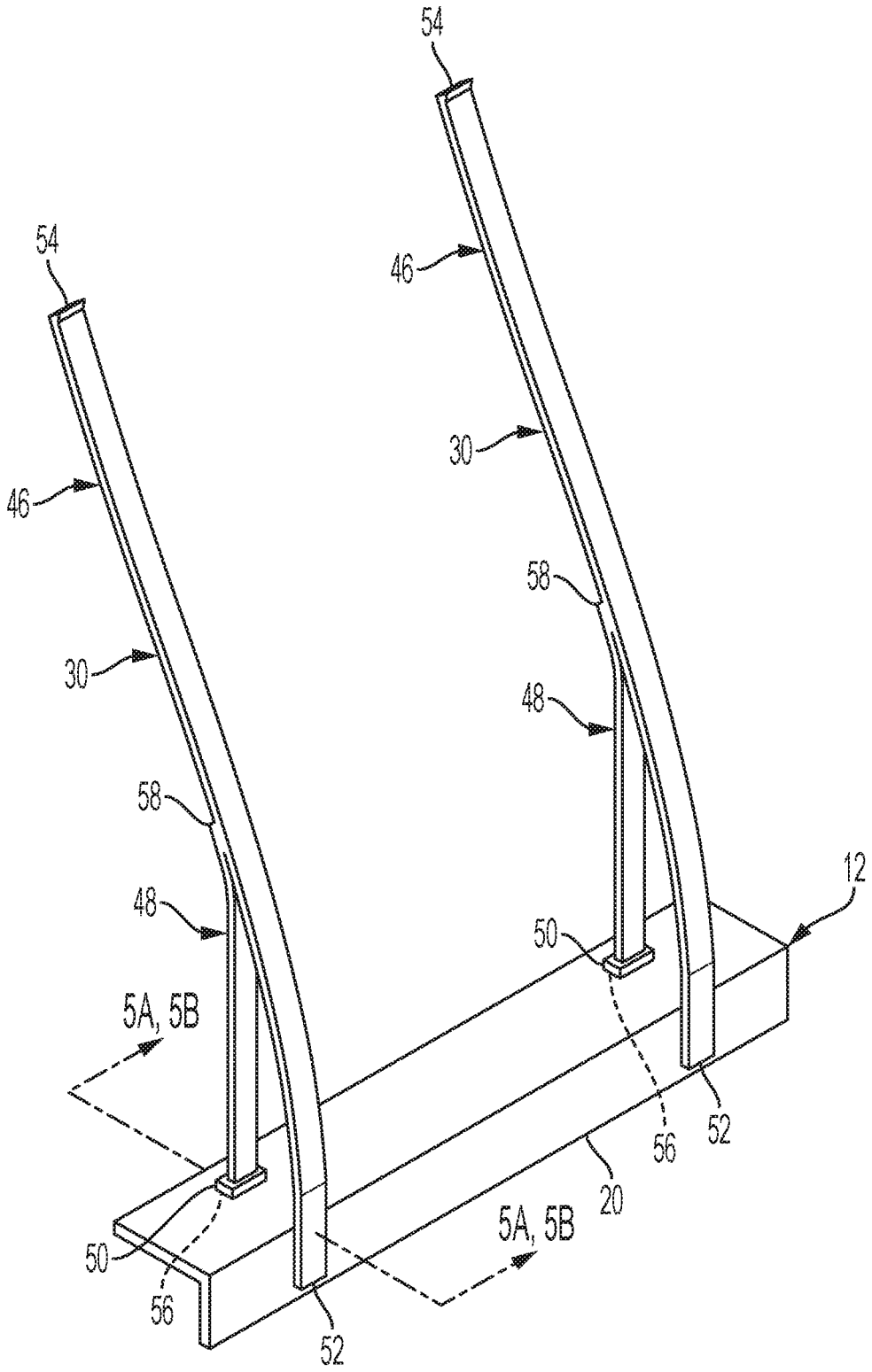
FIG. 4 is a schematic front perspective view of a portion of a base and a pair of back supports of the chair of FIG. 1, according to some embodiments of this disclosure.

FIG. 4 is a schematic front perspective view of a portion of the base 12 and the pair of back supports 30 of the chair of FIG. 1, according to some embodiments of this disclosure. As shown in FIG. 4, each of the back supports 30 includes a first bar 46, a second bar 48, and a first stop device 50. The first bar 46 includes a first end 52 and a second end 54 opposite the first end 52. The second bar 48 includes a third end 56 and a fourth end 58 opposite the third end 56.

The first bar 46 and the second bar 48 are flexible bars that bend elastically upon the application of rearward force to the back support 30, and spring back to an unbent position upon removal of the rearward force. In the embodiment shown in FIG. 4, the first bar 46 and second bar 48 are illustrated a having a rectangular cross-section. However, it is understood that embodiments may include a first bar 46 and a second bar 48 having other cross-sectional shapes, such as circular, elliptical, triangular, or square, for example.

The first end 52 is fixed to the base support 20 of the base 12. The third end 56 (visible in FIGS. 5A and 5B) may be disposed adjacent to the base 12 and is moveable relative to the base 12. The third end 56 is spaced apart from the first end 52. The fourth end 58 is fixed to the first bar 46 between the first end 52 and the second end 54. Fixation of the first end 52 to the base support 20 and/or the fourth end 58 to the first bar 46 may be by welds, solders, brazes, adhesives, mechanical fasteners, or any combination thereof.

Figure 5A:
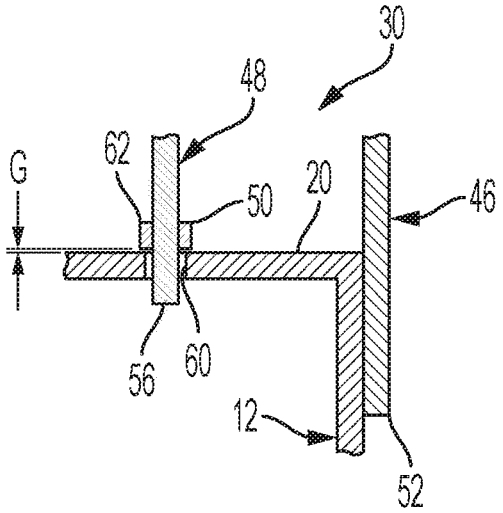
FIGS. 5A and 5B are schematic cross-sectional side views of a portion of the base and one of the pair of back supports of FIG. 4, according to some embodiments of this disclosure.
Figure 5B:
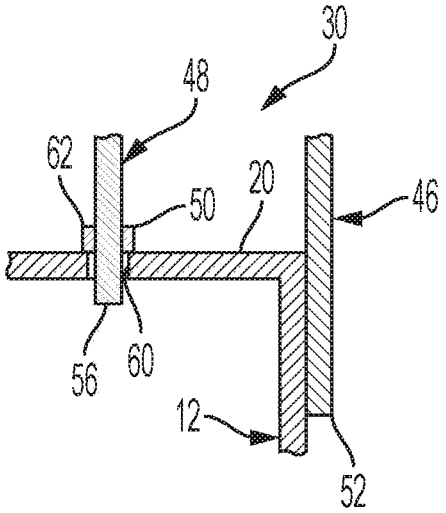

FIGS. 5A and 5B are schematic cross-sectional side views of a portion of the base 12 and one of the pair of back supports 30 of FIG. 4, according to some embodiments of this disclosure. As shown in FIG. 5A, the first stop device 50 may include a first hole 60 and a first stop element 62. The first hole 60 may be formed in the base support 20 of the base 12. The first hole 60 may be sized to permit unrestricted passage of the second bar 48. The first stop element 62 is fixed to, and projects from, the second bar 48. The first stop element 62 may be formed of any sturdy material that may be fixed to the second bar 48, such as metal, polymer, composite, or combinations thereof. The first stop element 62 may be fixed to the second bar 48 by welds, solders, brazes, adhesives, mechanical fasteners, or combinations thereof. The first stop element 62 is sized to prohibit passage into the first hole 60.

FIG. 5A shows the portion of the base 12 and one of the pair of back supports 30 when the back support 30 is unbent. That is, when no rearward force is applied to the back 14 (FIG. 1). The first stop element 62 is spaced from the base 12 such that a first gap G is formed when the back support 30 is unbent. As rearward force is initially applied to the back 14, the back support 30 bends rearward, exhibiting a first bending stiffness provided by the bending stiffness of the first bar 46. The second bar 48 does not bend, but moves downward through the first hole 60, moving the first stop element 62 closer to the base 12 and decreasing the first gap G between the first stop element 62 and the base 12.

FIG. 5B shows the portion of the base 12 and one of the pair of back supports 30 when the back support 30 is bent far enough that the first stop element 62 contacts the base 12, eliminating the first gap G between the first stop element 62 and the base 12. As additional rearward force is applied to the back 14 and the back support 30 continues to bend rearward, the second bar 48 must also bend because further movement of the second bar 48 downward through the first hole 60 is prevented by the first stop element 62. Thus, as the back support 30 continues to bend rearward, it exhibits a second bending stiffness that is greater than the first bending stiffness because the second bending stiffness is provided by the combination of the bending stiffness of the first bar 46 and the bending stiffness of the second bar 48. The point at which the bending stiffness of the back support 30 transitions from the first bending stiffness to the second bending stiffness is a first stop point. Thus, the action of the first stop device 50 between the second bar 48 and the base 12 determines the first stop point for the back support 30 by limiting and extent of movement of the second bar 48 relative to the base 12.

When the back support 30 is unbent, the first gap G may be as small as 0.025 inches, 0.050 inches, 0.075 inches, 0.100 inches, 0.125 inches 0.150 inches, or 0.175 inches, or as large as 0.20 inches, 0.25 inches, 0.30 inches, 0.35 inches, 0.40 inches, 0.45 inches, or 0.50 inches, or within any range defined between any two of the foregoing values, such as 0.025 to 0.5 inches, 0.050 to 0.45 inches, 0.075 to 0.40 inches, 0.100 to 0.35 inches, 0.125 to 0.30 inches, 0.150 to 0.25 inches, 0.175 inches to 0.20 inches, or 0.100 to 0.150 inches, for example.

Although the first hole 60 is illustrated in FIGS. 5A and 5B, and the third end 56 is shown penetrating through the base support 20, it is understood that embodiments include a cavity formed in base support 20 instead of the first hole 60 and with the third end 56 contained within the cavity.

Figure 6:
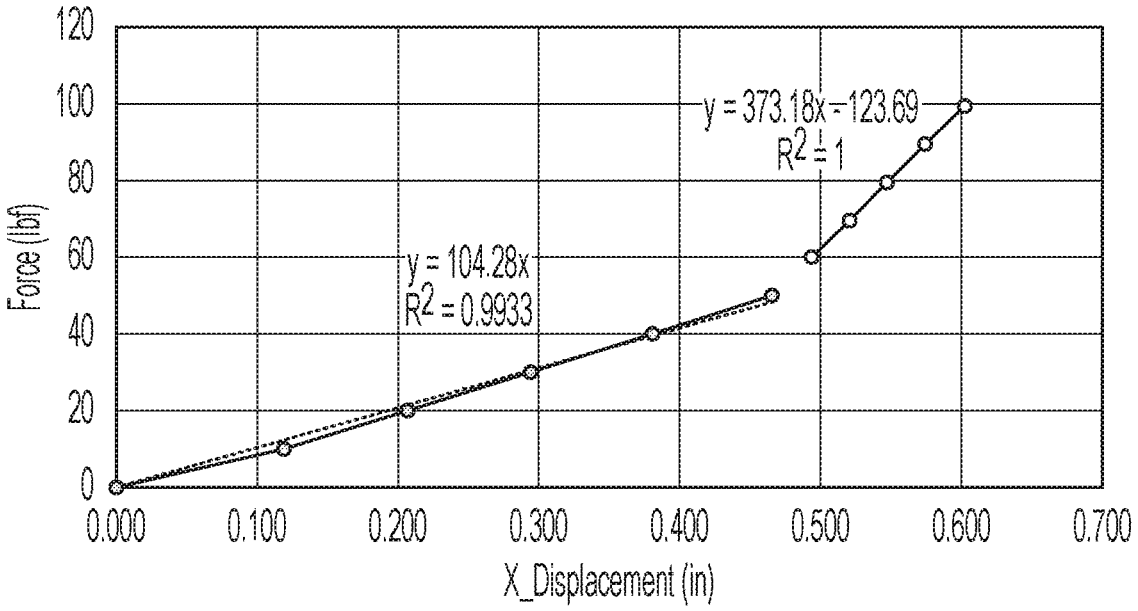
FIG. 6 is a graph illustrating a predicted bending stiffness of the pair of back supports of FIG. 4.

FIG. 6 is a graph illustrating a predicted bending stiffness of the pair of back supports 30 of FIG. 4. The prediction was made using Finite Element Analysis on Creo Simulate from PTC. FIG. 6 shows the predicted force required to displace the pair of back supports 30 rearward. As shown in FIG. 6, the initial force required to displace the back supports 30 rearward increases at a rate ranging from about 80 to 130 pounds of force per inch of displacement until the first stop point is reached at between about 0.47 and 0.49 inches of displacement, eliminating the first gap G between the first stop element 62 and the base 12. After the first stop point, the increase in force required to displace the back supports 30 rearward jumps to a rate well over 300 pounds of force per inch of displacement.

Thus, the chair 10 including the back 14 with the pair of back supports 30 facilitates movements associated with changing postures, seated office tasks, and stretching. Advantageously, the stiffness of the back 14 varies based on the amount of deflection. The initial stiffness is low, comfortably allowing a prescribed amount of movement by the occupant. Once movement exceeds the prescribed amount, and the first stop point is reached, the stiffness increases significantly to safely support the occupant, and to provide an indication of when the maximum safe deflection has been reached.

Figure 7:
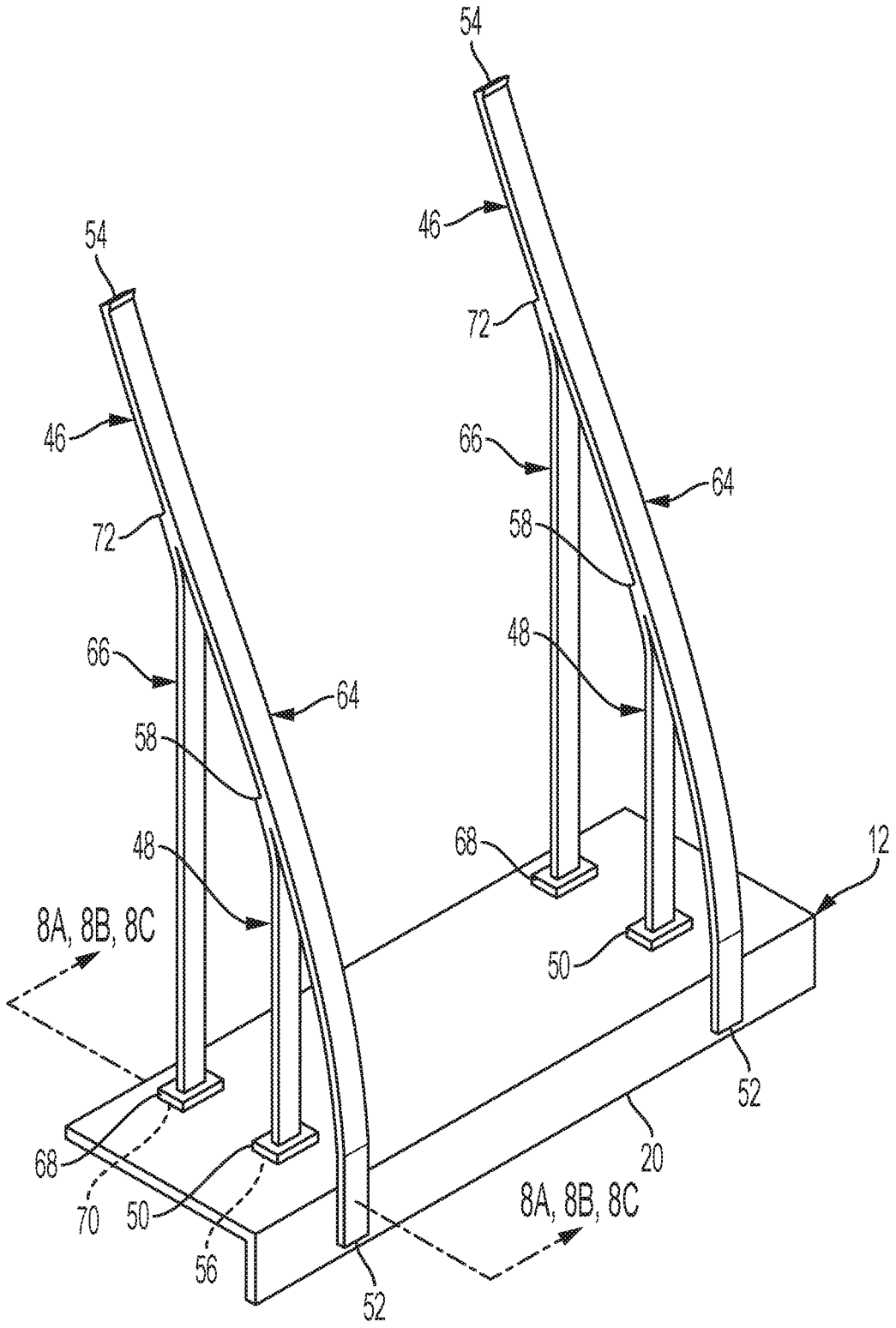
FIG. 7 is a schematic front perspective view of a portion of the base and another pair of back supports of the chair of FIG. 1, according to some embodiments of this disclosure.

FIG. 7 is a schematic front perspective view of a portion of the base 12 and another pair of back supports 64 of the chair of FIG. 1, according to some embodiments of this disclosure. The pair of back supports 64 may be used in chair 10 in place of the pair of back supports 30 described above. FIG. 7 shows the pair of back supports 64 extending from the base 12. The pair of back supports 64 may be substantially similar to the pair of back supports 30 described above, except that the pair of back supports 64 may further include a third bar 66 and a second stop device 68. The third bar 66 includes a fifth end 70 and a sixth end 72 opposite the fifth end 70.

As with the first bar 46 and the second bar 48, the third bar 66 is a flexible bar that bends elastically upon the application of rearward force to the back support 64, and springs back to an unbent position upon removal of the rearward force. In the embodiment shown in FIG. 7, the first bar 46, second bar 48 and third bar 66 are illustrated a having a rectangular cross-section. However, it is understood that embodiments may include a first bar 46, a second bar 48, and a third bar 66 having other cross-sectional shapes, such as circular, elliptical, triangular, or square, for example.

The fifth end 70 (visible in FIGS. 8A, 8B, and 8C) may be disposed adjacent to the base 12 and is moveable relative to the base 12. The fifth end 70 is spaced apart from the third end 56 on an opposite side of the second bar 48 from the first bar 46. The sixth end 72 is fixed to the first bar 46 between the fourth end 58 and the second end 54. Fixation of the sixth end 72 to the first bar 46 may be by welds, solders, brazes, adhesives, mechanical fasteners, or any combination thereof.

Figure 8A:
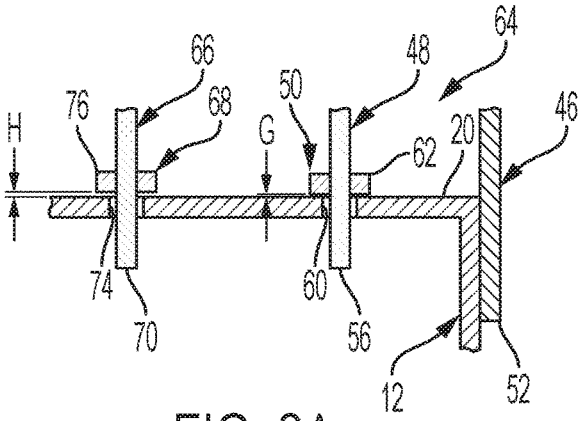
FIGS. 8A, 8B, and 8C are schematic cross-sectional side views of a portion of the base and one of the pair of back supports of FIG. 7, according to some embodiments of this disclosure.
Figure 8B:
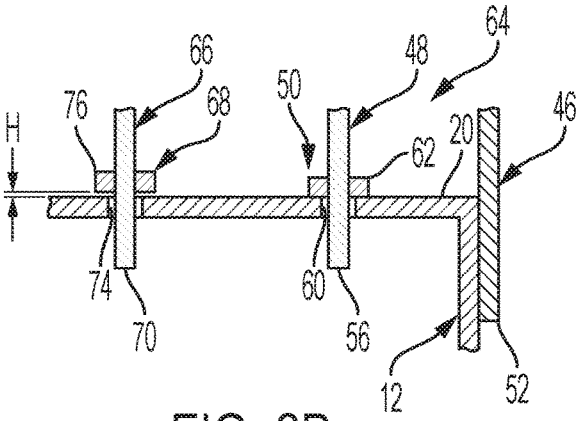
Figure 8C:
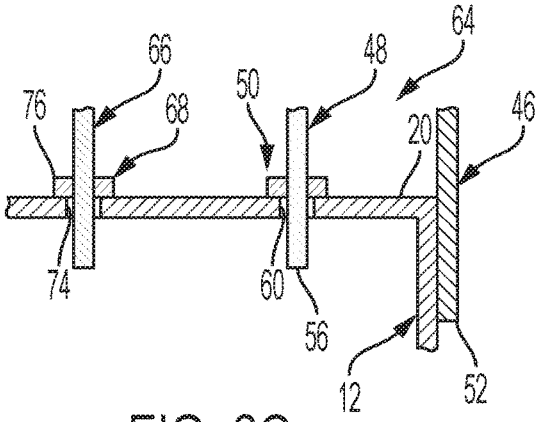

FIGS. 8A, 8B and 8C are schematic cross-sectional side views of a portion of the base 12 and one of the pair of back supports 66 of FIG. 7, according to some embodiments of this disclosure. As shown in FIG. 8A, the second stop device 68 may include a second hole 74 and a second stop element 76. The second hole 74 may be formed in the base support 20 of the base 12. The second hole 74 may be sized to permit unrestricted passage of the third bar 66. The second stop element 76 is fixed to, and projects from, the third bar 66. The second stop element 76 may be formed of any sturdy material that may be fixed to the third bar 66, such as metal, polymer, composite, or combinations thereof. The second stop element 76 may be fixed to the third bar 66 by welds, solders, brazes, adhesives, mechanical fasteners, or combinations thereof. The second stop element 74 is sized to prohibit passage into the second hole 74.

FIG. 8A shows the portion of the base 12 and one of the pair of back supports 64 when the back support 64 is unbent. That is, when no rearward force is applied to the back 14 (FIG. 1). The first stop element 62 is spaced from the base 12 such that the first gap G is formed when the back support 64 is unbent. The second stop element 76 is spaced from the base 12 such that a second gap H is formed when the back support 64 is unbent. The second gap H is greater than the first gap G when the back support 64 is unbent. As rearward force is initially applied to the back 14, the back support 64 bends rearward, exhibiting a first bending stiffness provided by the bending stiffness of the first bar 46. The second bar 48 does not bend, but moves downward through the second hole 60, moving the first stop element 62 closer to the base 12 and decreasing the first gap G between the first stop element 62 and the base 12. The third bar 48 also does not bend, but moves downward through the second hole 74, moving the second stop element 76 closer to the base 12 and decreasing the second gap H between the second stop element 76 and the base 12.

FIG. 8B shows the portion of the base 12 and one of the pair of back supports 64 when the back support 64 is bent far enough reach the first stop point when the first stop element 62 contacts the base 12, eliminating the first gap G between the first stop element 62 and the base 12. As additional rearward force is applied to the back 14 and the back support 64 continues to bend rearward, exhibiting the second bending stiffness provided by the bending stiffness of the first bar 46 and the second bar 48, the third bar 48 does not bend, but moves downward through the second hole 74, moving the second stop element 76 closer to the base 12 and decreasing the second gap H between the second stop element 76 and the base 12.

FIG. 8C shows the portion of the base 12 and one of the pair of back supports 64 when the back support 64 is bent far enough that the second stop element 76 contacts the base 12, eliminating the second gap H between the second stop element 76 and the base 12. As additional rearward force is applied to the back 14 and the back support 64 continues to bend rearward, the third bar 66 must also bend because further movement of the third bar 66 downward through the second hole 74 is prevented by the second stop element 76. Thus, as the back support 64 continues to bend rearward, it exhibits a third bending stiffness that is greater than the second bending stiffness because the third bending stiffness is provided by the combination of the bending stiffness of the first bar 46, the bending stiffness of the second bar 48 and the bending stiffness of the third bar 66. The point at which the bending stiffness of the back support 64 transitions from the second bending stiffness to the third bending stiffness is a second stop point. Thus, the action of the second stop device 50 between the third bar 66 and the base 12 determines the second stop point for the back support 64 by limiting and extent of movement of the third bar 66 relative to the base 12.

When the back support 64 is unbent, the second gap H may be greater than the first gap G by as little as 0.025 inches, 0.050 inches, 0.075 inches, 0.100 inches, 0.125 inches 0.150 inches, or 0.175 inches, or as much as 0.20 inches, 0.25 inches, 0.30 inches, 0.35 inches, 0.40 inches, 0.45 inches, or 0.50 inches, or within any range defined between any two of the foregoing values, such as 0.025 to 0.5 inches, 0.050 to 0.45 inches, 0.075 to 0.40 inches, 0.100 to 0.35 inches, 0.125 to 0.30 inches, 0.150 to 0.25 inches, 0.175 inches to 0.20 inches, or 0.100 to 0.150 inches, for example.

Although the second hole 74 is illustrated in FIGS. 8A, 8B and 8C, and the fifth end 70 is shown penetrating through the base support 20, it is understood that embodiments include a cavity formed in base support 20 instead of the second hole 74 and with the fifth end 70 contained within the cavity.

Figure 9:
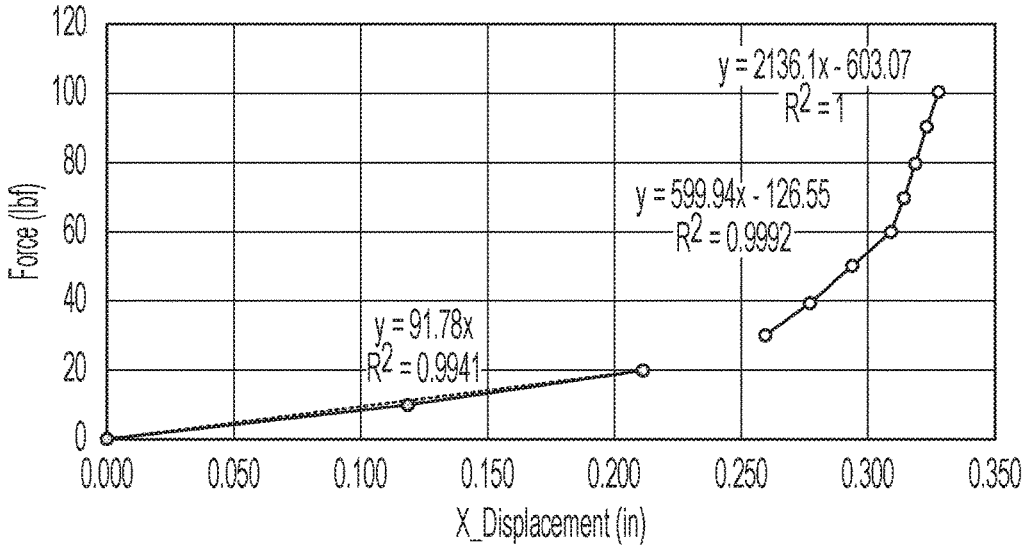
FIG. 9 is a graph illustrating a predicted bending stiffness of the pair of back supports of FIG. 7.

FIG. 9 is a graph illustrating a predicted bending stiffness of the pair of back supports 64 of FIG. 7. The prediction was made using Finite Element Analysis on Creo Simulate from PTC. FIG. 9 shows the predicted force required to displace the pair of back supports 64 rearward. As shown in FIG. 9, the initial force required to displace the back supports 64 rearward increases at a rate of about 90 pounds of force per inch of displacement until the first stop point is reached at between about 0.22 and 0.26 inches of displacement, eliminating the first gap G between the first stop element 62 and the base 12. After the first stop point, the increase in force required to displace the back supports 64 rearward jumps to a rate well over 600 pounds of force per inch of displacement. The force increases again to over 2,000 pounds of force per inch of displacement after the second stop point at around 0.31 inches of displacement, eliminating the second gap H between the second stop element 76 and the base 12.

Thus, the chair 10 including the back 14 with the pair of back supports 64 facilitates movements associated with changing postures, seated office tasks, and stretching. Advantageously, the stiffness of the back 14 varies based on the amount of deflection. The initial stiffness is low until the first stop point is reached, then increases until the second stop point is reached, comfortably allowing a prescribed amount of movement by the occupant. Once movement exceeds the prescribed amount, and the second stop point is reached, the stiffness increases significantly to safely support the occupant, and to provide an indication of that when the maximum safe deflection has been reached. The two-levels of stiffness provide a more continuous increase in the stiffness before the maximum safe deflection is reached when compared to the embodiment described above with the pair of back supports 30. While the embodiment of the chair 10 including the pair of back supports 64 is shown with two stop points, it is understood that embodiments include chairs having back supports with more than two stop points, such as three stop points, four stop points, or more than four stop points.

Figure 10:
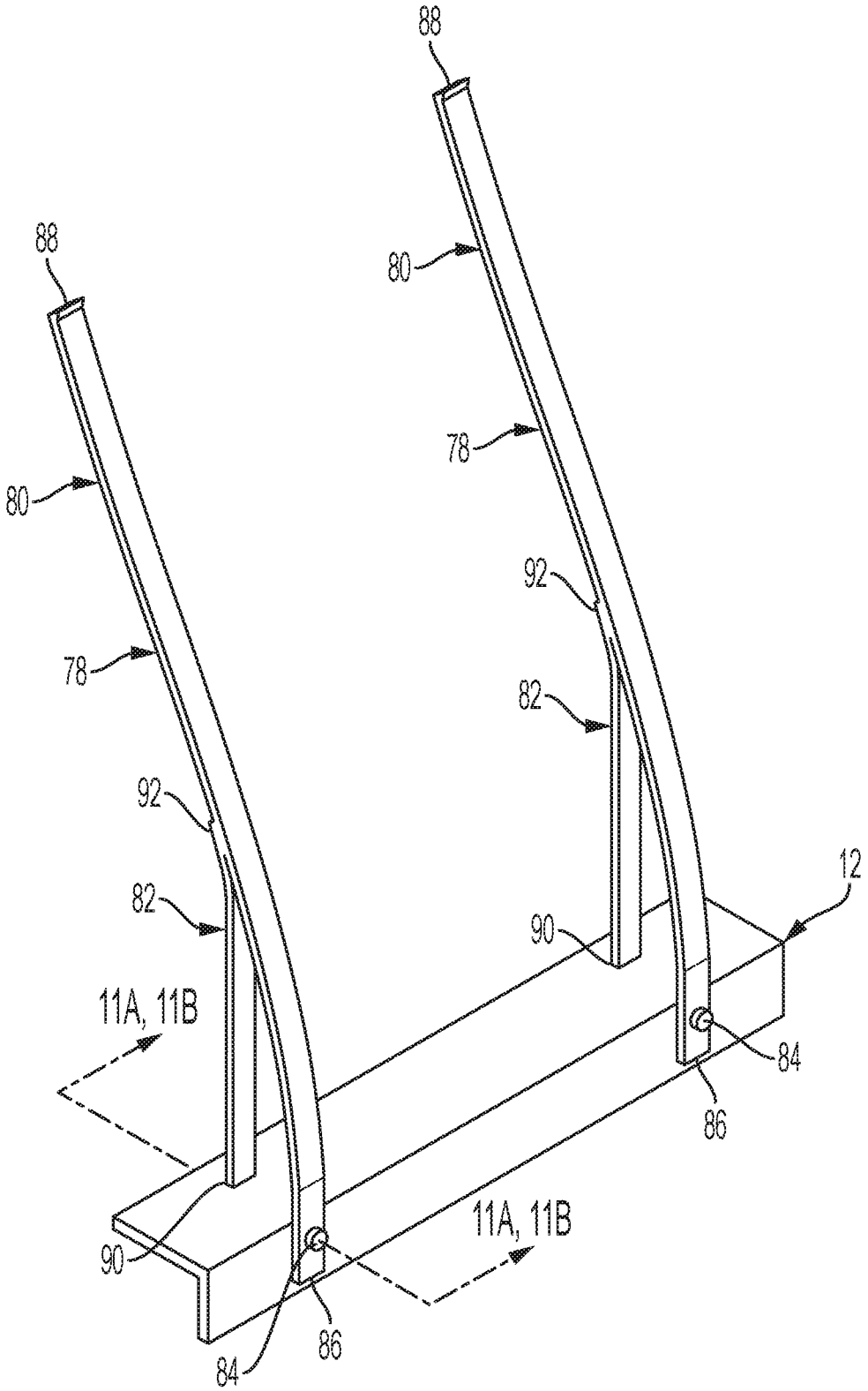
FIG. 10 is a schematic front perspective view of a portion of a base and yet another pair of back supports of the chair of FIG. 1, according to some embodiments of this disclosure.

FIG. 10 is a schematic front perspective view of a portion of the base 12 and another pair of back supports 78 of the chair of FIG. 1, according to some embodiments of this disclosure. The pair of back supports 78 may be used in chair 10 in place of the pair of back supports 30 described above. FIG. 10 shows the pair of back supports 78 extending from the base 12. As shown in FIG. 10, each of the back supports 78 includes a first bar 80, a second bar 82, and a stop device 84. The first bar 80 includes a first end 86 and a second end 88 opposite the first end 86. The second bar 82 includes a third end 90 and a fourth end 92 opposite the third end 90. The first bar 80 and the second bar 82 may be substantially similar to the first bar 46 and the second bar 48 described above with respect to flexibility and cross-sectional shapes.

The first end 86 may be disposed adjacent to the base 12 and is moveable relative to the base 12. The third end 90 is spaced apart from the first end 86. The fourth end 92 is fixed to the first bar 80 between the first end 86 and the second end 88. Fixation of the third end 90 to the base support 20 and/or the fourth end 92 to the first bar 80 may be by welds, solders, brazes, adhesives, mechanical fasteners, or any combination thereof.

Figure 11A:
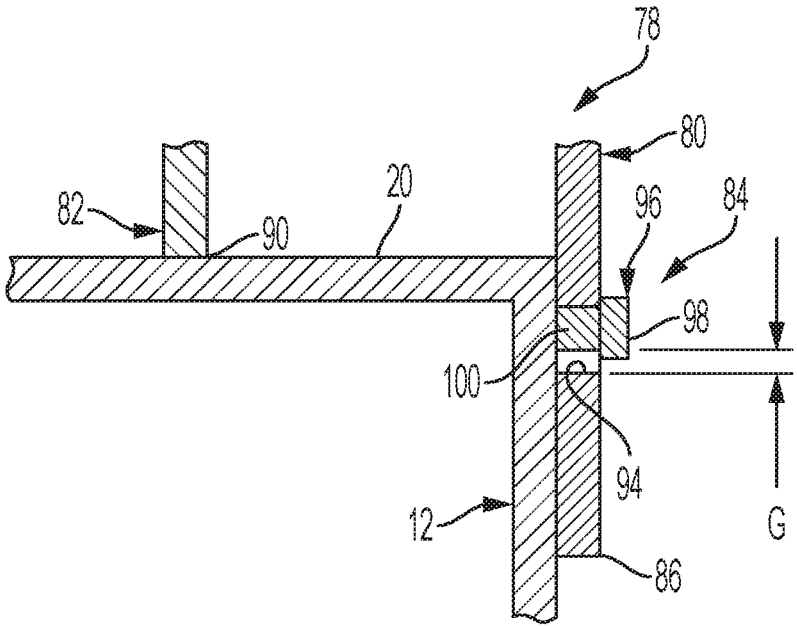
FIGS. 11A and 11B are schematic cross-sectional side views of a portion of the base and one of the pair of back supports of FIG. 10, according to some embodiments of this disclosure.
Figure 11B:
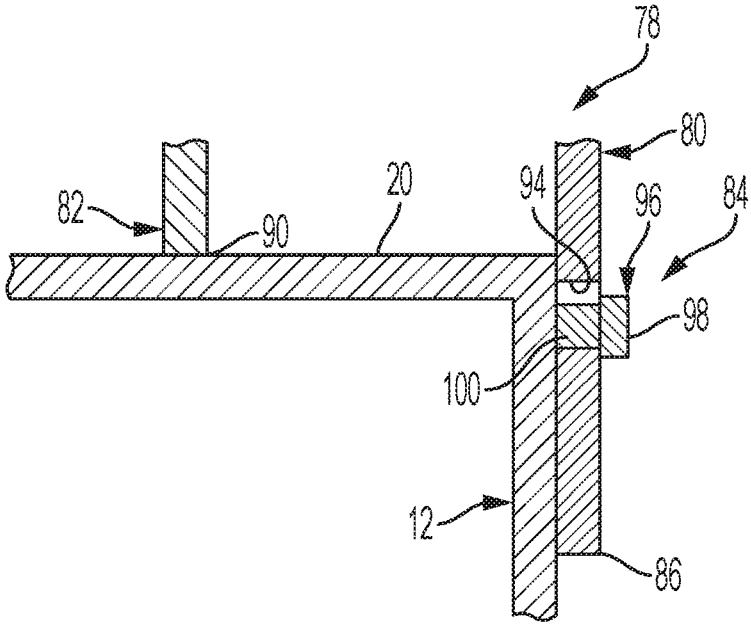

FIGS. 11A and 11B are schematic cross-sectional side views of a portion of the base 12 and one of the pair of back supports 78 of FIG. 10, according to some embodiments of this disclosure. As shown in FIG. 11A, the stop device 84 may include a hole 90 and a stop element 96. The hole 94 may be formed through the first bar 80 at the first end 86. The stop element 96 is fixed to, and projects from, the base 12. The stop element 96 may include a head 98 and a shaft 100 connecting the head 98 to the base 12. The stop element 96 may be formed of any sturdy material that may be fixed to the base 12, such as metal, polymer, composite, or combinations thereof. The shaft 100 of the stop element 96 may be fixed to the base 12 by welds, solders, brazes, adhesives, mechanical fasteners, or combinations thereof. The shaft 100 may extend through the hole 94. The head 98 may be sized to prevent the first bar 90 from disengaging form the shaft 100.

FIG. 11A shows the portion of the base 12 and one of the pair of back supports 78 when the back support 78 is unbent. That is, when no rearward force is applied to the back 14 (FIG. 1). The hole 94 may be sized such that when the back support 78 is unbent, a gap G is formed between the shaft 100 and the first bar 80 on a lower side of the shaft 100 while an opposite, upper side of the shaft 100 contacts the first bar 80. As rearward force is initially applied to the back 14, the back support 78 bends rearward, exhibiting a first bending stiffness provided by the bending stiffness of the second bar 82 and a portion of the first bar 80 extending from the second end 88 to where the fourth end 92 is fixed to the first bar 80. The portion of the first bar 80 extending from where the fourth end 92 is fixed to the first bar 80 to the first end 86 does not bend, but moves upward, vertically unrestrained by the stop element 96, and decreasing the gap G between the shaft 100 and the first bar 80 on the lower side of the shaft 100.

FIG. 11B shows the portion of the base 12 and one of the pair of back supports 78 when the back support 78 is bent far enough that the shaft 100 contacts the first bar 80 on the lower side of the shaft 100, eliminating the first gap G. As additional rearward force is applied to the back 14 and the back support 78 continues to bend rearward, the portion of the first bar 80 extending from where the fourth end 92 is fixed to the first bar 80 to the first end 86 must also bend because further upward movement of the first bar 80 is prevented by the shaft 100 of the stop element 96. Thus, as the back support 76 continues to bend rearward, it exhibits a second bending stiffness that is greater than the first bending stiffness because the second bending stiffness is provided by the combination of the bending stiffness of the entire first bar 80 and the bending stiffness of the second bar 82. The point at which the bending stiffness of the back support 78 transitions from the first bending stiffness to the second bending stiffness is a stop point. Thus, the action of the stop device 96 between the first end 86 of the first bar 80 and the base 12 determines the stop point for the back support 78 by limiting the extent of movement of the first end 86 of the first bar 80 relative to the base 12.

When the back support 78 is unbent, the gap G may be as small as 0.025 inches, 0.050 inches, 0.075 inches, 0.100 inches, 0.125 inches 0.150 inches, or 0.175 inches, or as large as 0.20 inches, 0.25 inches, 0.30 inches, 0.35 inches, 0.40 inches, 0.45 inches, or 0.50 inches, or within any range defined between any two of the foregoing values, such as 0.025 to 0.5 inches, 0.050 to 0.45 inches, 0.075 to 0.40 inches, 0.100 to 0.35 inches, 0.125 to 0.30 inches, 0.150 to 0.25 inches, 0.175 inches to 0.20 inches, or 0.100 to 0.150 inches, for example.

Figure 12:
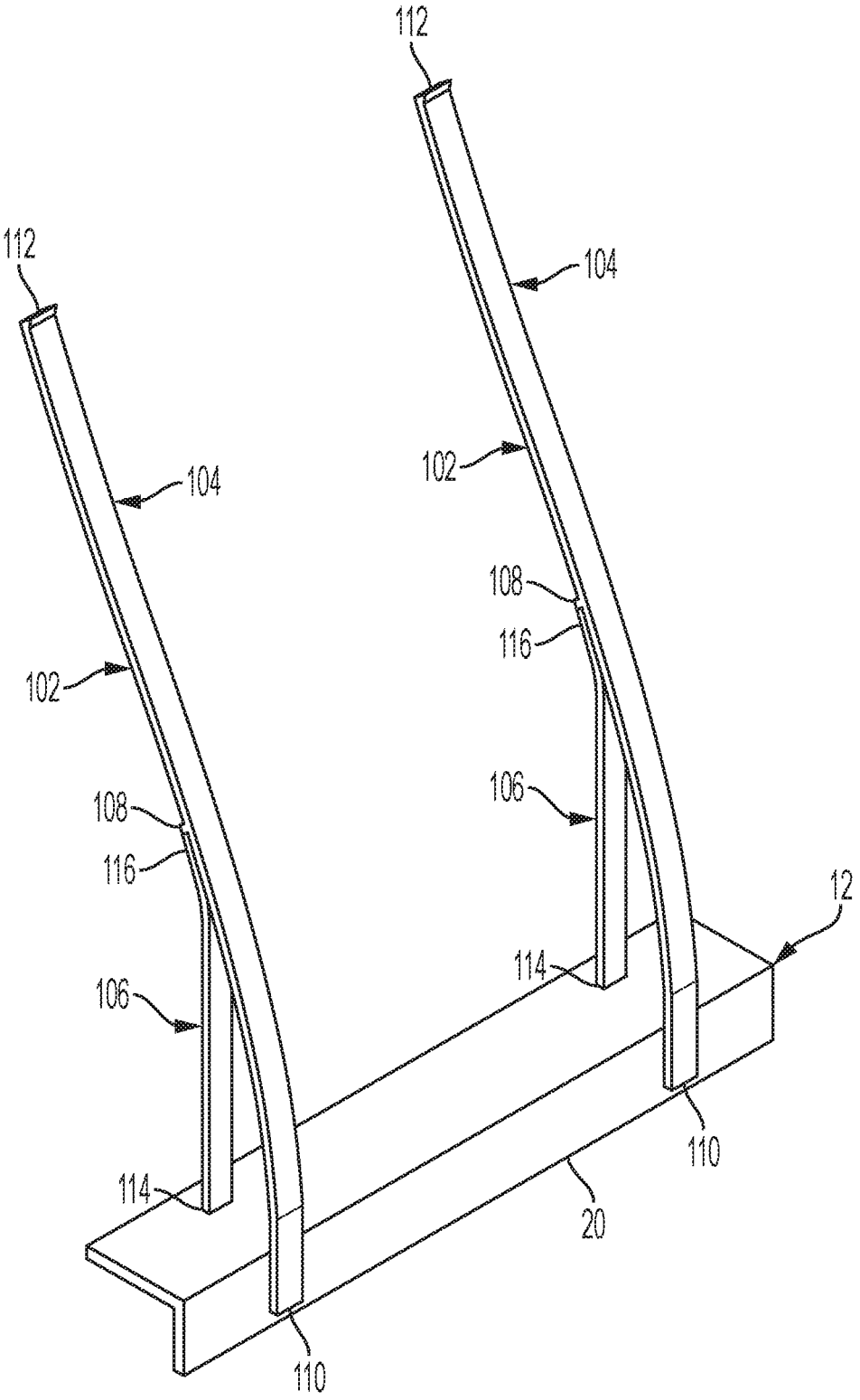
FIG. 12 is a schematic front perspective view of a portion of a base and another pair of back supports of the chair of FIG. 1, according to some embodiments of this disclosure.

FIG. 12 is a schematic front perspective view of a portion of the base 12 and yet another pair of back supports 102 of the chair of FIG. 1, according to some embodiments of this disclosure. The pair of back supports 102 may be used in chair 10 in place of the pair of back supports 30 described above. FIG. 12 shows the pair of back supports 102 extending from the base 12. As shown in FIG. 12, each of the back supports 102 includes a first bar 104, a second bar 106, and a stop device 108. The first bar 102 includes a first end 110 and a second end 112 opposite the first end 110. The second bar 106 includes a third end 114 and a fourth end 116 opposite the third end 114. The first bar 104 and the second bar 106 may be substantially similar to the first bar 46 and the second bar 48 described above with respect to flexibility and cross-sectional shapes.

The first end 110 may fixed to the base 12. The third end 114 may also be fixed to the base 12, and be spaced apart from the first end 110. The fourth end 116 is disposed adjacent to the first bar 104 between the first end 110 and the second end 112. The fourth end 116 is in sliding engagement with the first bar 104. Fixation of the first end 110 and/or the third end 114 to the base support 20 of the base 12 may be by welds, solders, brazes, adhesives, mechanical fasteners, or any combination thereof.

Figure 13A:
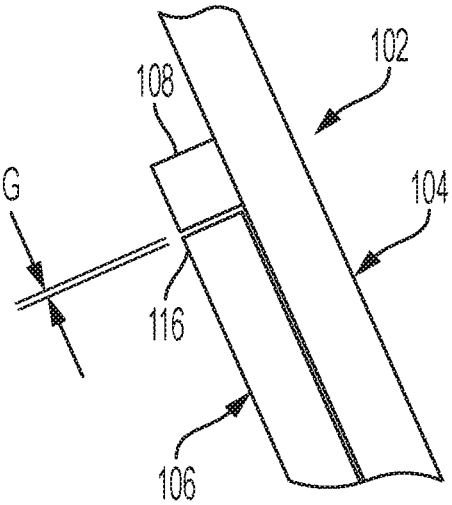
FIGS. 13A and 13B are schematic side views of a portion of the one of the pair of back supports of FIG. 12, according to some embodiments of this disclosure.
Figure 13B:
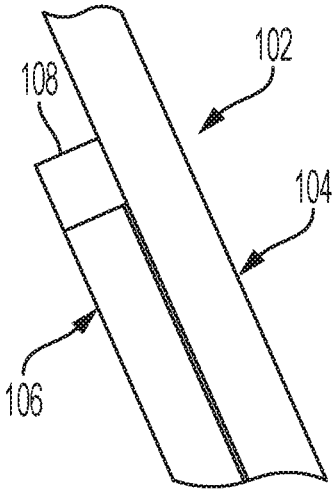

FIGS. 13A and 13B are schematic side views of a portion of one of the pair of back supports 102 of FIG. 12, according to some embodiments of this disclosure. As shown in FIG. 13A, the first stop device 108 may project from the first bar 104. In some embodiments, the first stop device 108 may project from the first bar 104 in a direction perpendicular to the first bar 104. The first stop device 108 may be formed of any sturdy material that may be fixed to the first bar 104, such as metal, polymer, composite, or combinations thereof. In some embodiments, the first stop device 108 may be integrally formed with the first bar 104, as shown in FIGS. 13A and 13B. In some other embodiments, the first stop device 108 may be fixed to the first bar 104 by welds, solders, brazes, adhesives, mechanical fasteners, or combinations thereof.

FIG. 13A shows the portion one of the pair of back supports 102 when the back support 102 is unbent. That is, when no rearward force is applied to the back 14 (FIG. 1). The first stop device 108 is disposed along the first bar 104 such that a first gap G between the first stop device 108 and fourth end 116 is formed when the back support 102 is unbent. As rearward force is initially applied to the back 14, the back support 102 bends rearward, exhibiting a first bending stiffness provided by the bending stiffness of the first bar 104. The second bar 106 slides along the first bar 104, decreasing the first gap G between the first stop device 108 and the fourth end 116. The second bar 106 also contributes to the first bending stiffness, but to a lesser degree because the sliding action reduces the amount of bending by the second bar 106.

FIG. 13B shows the portion of one of the pair of back supports 102 when the back support 102 is bent far enough that the fourth end 116 contacts the first stop device 108, eliminating the first gap G. As additional rearward force is applied to the back 14 and the back support 102 continues to bend rearward, the second bar 106 must bend fully along with the first bar 104 because further movement of the second bar 106 along the first bar 104 is prevented by the first stop device 108. Thus, as the back support 102 continues to bend rearward, it exhibits a second bending stiffness that is greater than the first bending stiffness because the second bending stiffness is provided by the combination of the bending stiffness of the first bar 104 and the full bending stiffness of the second bar 106. The point at which the bending stiffness of the back support 102 transitions from the first bending stiffness to the second bending stiffness is a first stop point. Thus, the action of the first stop device 108 between the fourth end 116 and the first bar 104 determines the first stop point for the back support 102 by limiting and extent of the sliding engagement of the fourth end 116 with the first bar 104.

When the back support 102 is unbent, the first gap G may be as small as 0.025 inches, 0.050 inches, 0.075 inches, 0.100 inches, 0.125 inches 0.150 inches, or 0.175 inches, or as large as 0.20 inches, 0.25 inches, 0.30 inches, 0.35 inches, 0.40 inches, 0.45 inches, or 0.50 inches, or within any range defined between any two of the foregoing values, such as 0.025 to 0.5 inches, 0.050 to 0.45 inches, 0.075 to 0.40 inches, 0.100 to 0.35 inches, 0.125 to 0.30 inches, 0.150 to 0.25 inches, 0.175 inches to 0.20 inches, or 0.100 to 0.150 inches, for example.

Figure 14:
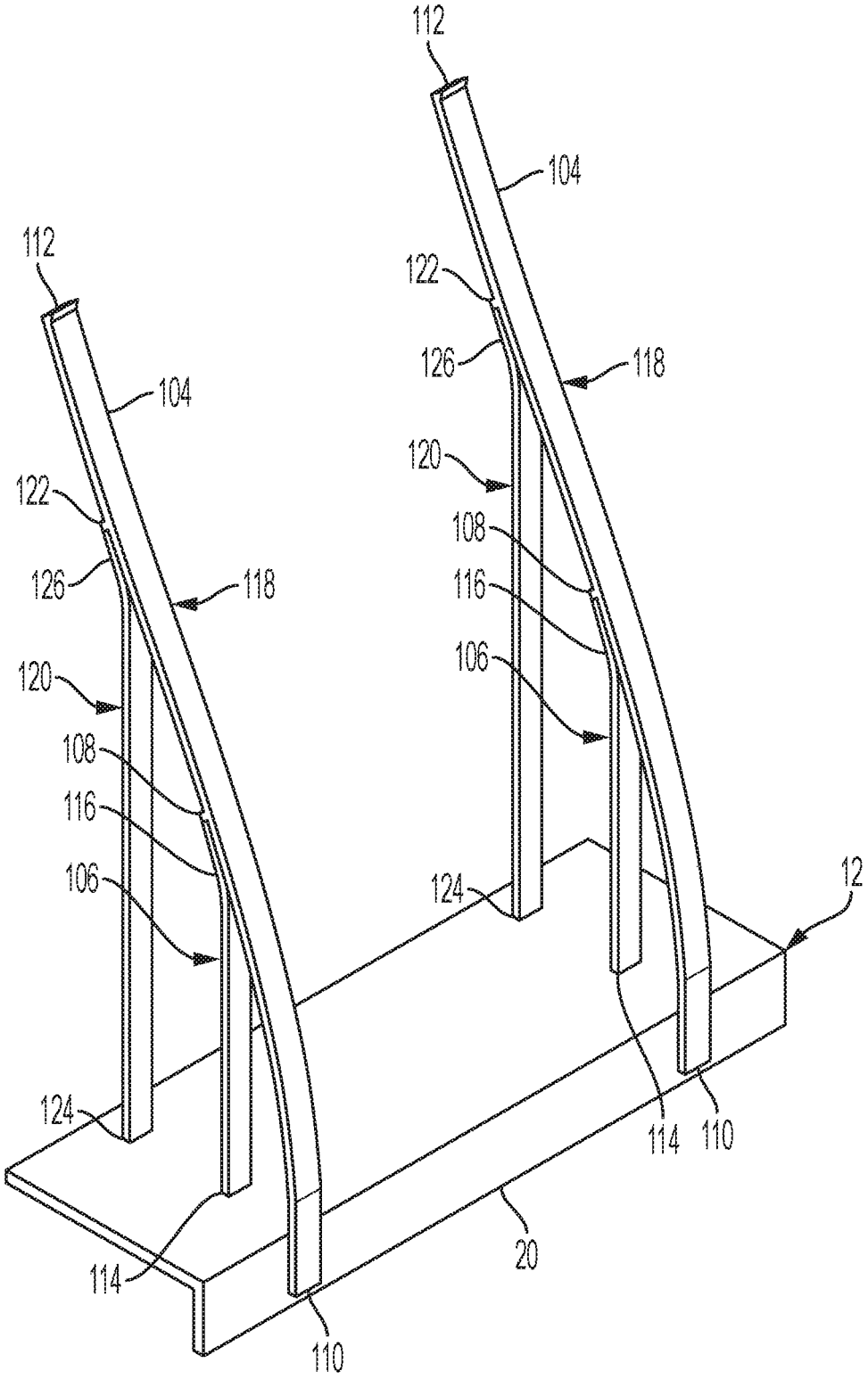
FIG. 14 is a schematic front perspective view of a portion of the base and another pair of back supports of the chair of FIG. 1, according to some embodiments of this disclosure.

FIG. 14 is a schematic front perspective view of a portion of the base 12 and another pair of back supports 118 of the chair of FIG. 1, according to some embodiments of this disclosure. The pair of back supports 118 may be used in chair 10 in place of the pair of back supports 30 described above. FIG. 14 shows the pair of back supports 118 extending from the base 12. The pair of back supports 118 may be substantially similar to the pair of back supports 102 described above, except that the pair of back supports 118 may further include a third bar 120 and a second stop device 122. The third bar 120 includes a fifth end 124 and a sixth end 126 opposite the fifth end 124. The third bar 120 may be substantially similar to the first bar 46 described above with respect to flexibility.

The fifth end 124 may fixed to the base 12, and be spaced apart from the third end 114 on an opposite side of the second bar 106 from the first bar 104. Fixation of the fifth end 124 may be by welds, solders, brazes, adhesives, mechanical fasteners, or any combination thereof. The sixth end 126 is disposed adjacent to the first bar 104 between the first stop device 108 and the second end 112. The sixth end 126 is in sliding engagement with the first bar 104.

Figure 15A:
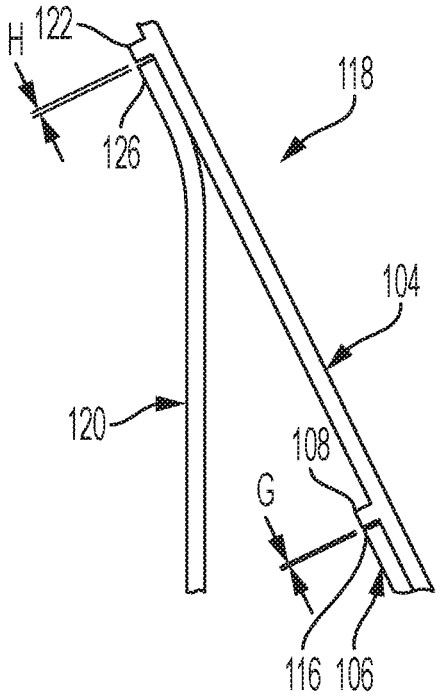
FIGS. 15A, 15B, and 15C are cross-sectional side views of a portion of one of the pair of back supports of FIG. 14, according to some embodiments of this disclosure.
Figure 15B:
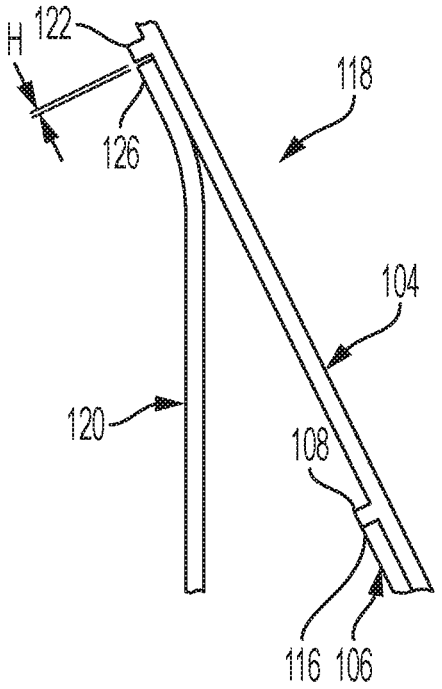
Figure 15C:
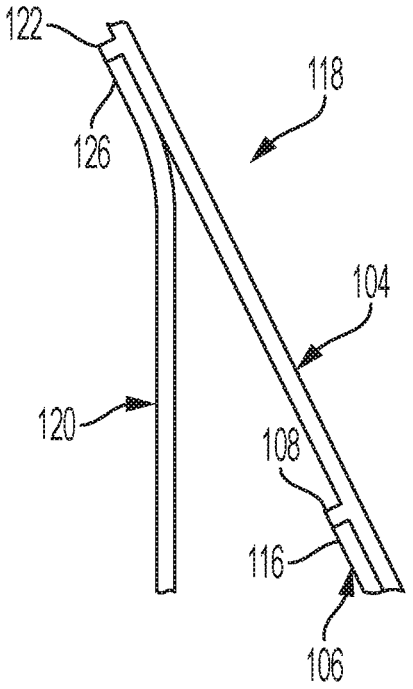

FIGS. 15A, 15B and 15C are schematic side views of a portion of the one of the pair of back supports 118 of FIG. 14, according to some embodiments of this disclosure. As shown in FIG. 15A, the second stop device 122 may project from the first bar 104. In some embodiments, the second stop device 122 may project from the first bar 104 in a direction perpendicular to the first bar 104. The second stop device 122 may be formed of any sturdy material that may be fixed to the first bar 104, such as metal, polymer, composite, or combinations thereof. In some embodiments, the second stop device 122 may be integrally formed with the first bar 104, as shown in FIGS. 15A, 15B and 15C. In some other embodiments, the second stop device 122 may be fixed to the first bar 104 by welds, solders, brazes, adhesives, mechanical fasteners, or combinations thereof.

FIG. 15A shows the portion one of the pair of back supports 64 when the back support 118 is unbent. That is, when no rearward force is applied to the back 14 (FIG. 1). The first stop device 108 is disposed along the first bar 104 such that a first gap G between the first stop device 108 and fourth end 116 is formed when the back support 118 is unbent. The second stop device 122 is disposed along the first bar 104 such that a second gap H between the second stop device 122 and sixth end 126 is formed when the back support 118 is unbent. The second gap H is greater than the first gap G when the back support 64 is unbent. As rearward force is initially applied to the back 14, the back support 118 bends rearward, exhibiting a first bending stiffness provided by the bending stiffness of the first bar 104. The second bar 106 slides along the first bar 104, decreasing the first gap G between the first stop device 108 and the fourth end 116. The third bar 120 also slides along the first bar 104, decreasing the second gap H between the second stop device 122 and the sixth end 126. The second bar 106 and the third bar 120 also contributes to the first bending stiffness, but to a lesser degree because the sliding action reduces the amount of bending by the second bar 106 and the third bar 120.

FIG. 15B shows the portion of one of the pair of back supports 118 when the back support 118 is bent far enough that the fourth end 116 contacts the first stop device 108, eliminating the first gap G. As additional rearward force is applied to the back 14 and the back support 118 continues to bend rearward, the second bar 106 must bend fully along with the first bar 104 because further movement of the second bar 106 along the first bar 104 is prevented by the first stop device 108. Thus, as the back support 102 continues to bend rearward, it exhibits a second bending stiffness that is greater than the first bending stiffness because the second bending stiffness is provided by the combination of the bending stiffness of the first bar 104 and the full bending stiffness of the second bar 106. The third bar 120 continues slides along the first bar 104, decreasing the second gap H between the second stop device 122 and the sixth end 126. The third bar 120 also contributes to the second bending stiffness, but to a lesser degree because the sliding action reduces the amount of bending by the third bar 120. The point at which the bending stiffness of the back support 118 transitions from the first bending stiffness to the second bending stiffness is a first stop point. Thus, the action of the first stop device 108 between the fourth end 116 and the first bar 104 determines the first stop point for the back support 118 by limiting and extent of the sliding engagement of the fourth end 116 with the first bar 104.

FIG. 15C shows the portion of one of the pair of back supports 118 when the back support 118 is bent far enough that the sixth end 126 contacts the second stop device 122, eliminating the second gap H. As additional rearward force is applied to the back 14 and the back support 118 continues to bend rearward, the third bar 120 must bend fully along with the first bar 104 because further movement of the third bar 120 along the first bar 104 is prevented by the second stop device 122. Thus, as the back support 118 continues to bend rearward, it exhibits a third bending stiffness that is greater than the second bending stiffness because the third bending stiffness is provided by the combination of the bending stiffness of the first bar 104 and the full bending stiffness of the second bar 106 and the third bar 120. The point at which the bending stiffness of the back support 118 transitions from the second bending stiffness to the third bending stiffness is a second stop point. Thus, the action of the second stop device 122 between the sixth end 126 and the first bar 104 determines the second stop point for the back support 118 by limiting and extent of the sliding engagement of the sixth end 126 with the first bar 104.

When the back support 118 is unbent, the second gap H may be greater than the first gap G by as little as 0.025 inches, 0.050 inches, 0.075 inches, 0.100 inches, 0.125 inches 0.150 inches, or 0.175 inches, or as much as 0.20 inches, 0.25 inches, 0.30 inches, 0.35 inches, 0.40 inches, 0.45 inches, or 0.50 inches, or within any range defined between any two of the foregoing values, such as 0.025 to 0.5 inches, 0.050 to 0.45 inches, 0.075 to 0.40 inches, 0.100 to 0.35 inches, 0.125 to 0.30 inches, 0.150 to 0.25 inches, 0.175 inches to 0.20 inches, or 0.100 to 0.150 inches, for example.

Thus, the chair 10 including the back 14 with the any of the pair of back supports 30, 64, 78, 102 or 118 described above facilitates movements associated with changing postures, seated office tasks, and stretching. Advantageously, the stiffness of the back 14 varies based on the amount of deflection. The initial stiffness is low, comfortably allowing a prescribed amount of movement by the occupant. Once movement exceeds the prescribed amount, and the first stop point is reached, the stiffness increases significantly to safely support the occupant, and to provide an indication of when the maximum safe deflection has been reached.

Figure 16:
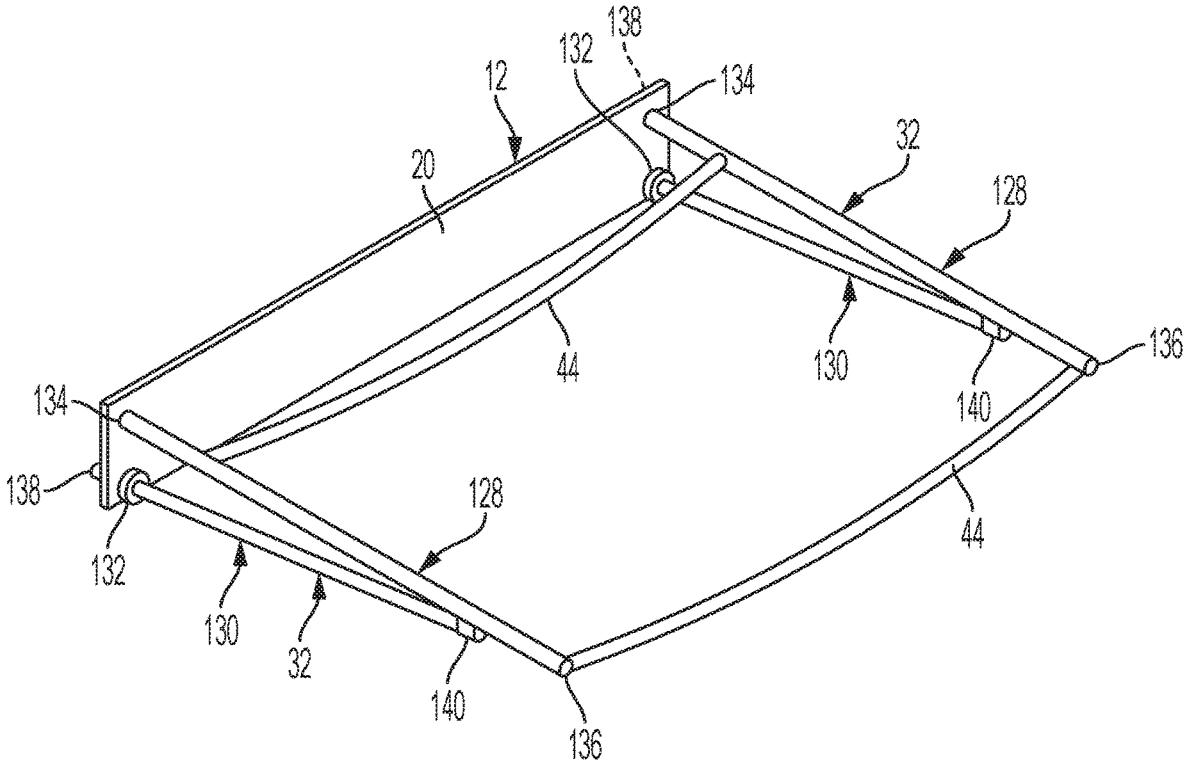
FIG. 16 is a schematic front perspective view of a portion of a base and a pair of seat supports of the chair of FIG. 1, according to some embodiments of this disclosure.

FIG. 16 is a schematic front perspective view of a portion of the base 12 and the pair of seat supports 32 of the chair of FIG. 1, according to some embodiments of this disclosure. As shown in FIG. 16, each of the seat supports 32 includes a first bar 128, a second bar 130, and a stop device 132. The first bar 128 includes a first end 134 and a second end 136 opposite the first end 134. The second bar 130 includes a third end 138 (one visible in FIG. 16) and a fourth end 140 opposite the third end 138.

The first bar 128 and the second bar 130 are flexible bars that bend elastically upon the application of downward force to the seat support 32, and spring back to an unbent position upon removal of the rearward force. In the embodiment shown in FIG. 16, the first bar 128 and second bar 130 are illustrated a having a circular cross-section. However, it is understood that embodiments may include a first bar 128 and a second bar 130 having other cross-sectional shapes, such as rectangular, elliptical, triangular, or square, for example.

The first end 134 is fixed to the base support 20 of the base 12. The third end 138 may be disposed adjacent to the base 12 and is moveable relative to the base 12. The third end 138 is spaced apart from the first end 134. The fourth end 140 is fixed to the first bar 128 between the first end 134 and the second end 136. Fixation of the first end 134 to the base support 20 and/or the fourth end 140 to the first bar 128 may be by welds, solders, brazes, adhesives, mechanical fasteners, or any combination thereof.

Figure 17A:
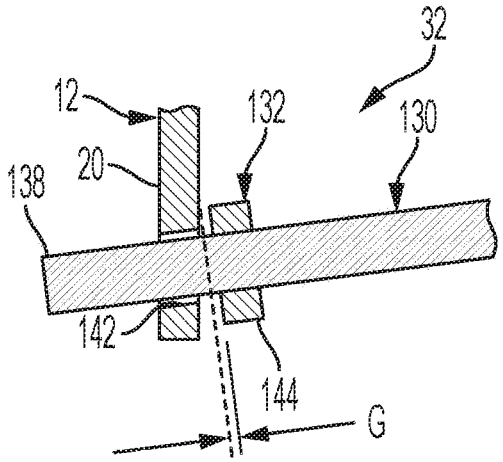
FIGS. 17A and 17B are schematic cross-sectional side views of a portion of the base and one of the pair of seat supports of FIG. 16, according to some embodiments of this disclosure.
Figure 17B:
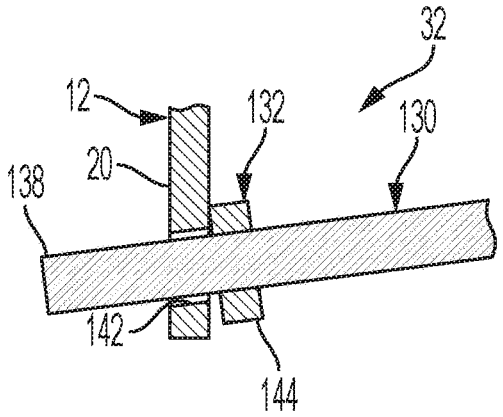

FIGS. 17A and 17B are schematic cross-sectional side views of a portion of the base 12 and one of the pair of seat supports 32 of FIG. 16, according to some embodiments of this disclosure. As shown in FIG. 17A, the stop device 132 may include a hole 142 and a stop element 144. The hole 142 may be formed in the base support 20 of the base 12. The hole 142 may be sized to permit unrestricted passage of the second bar 130. The stop element 144 is fixed to, and projects from, the second bar 130. The stop element 144 may be formed of any sturdy material that may be fixed to the second bar 130, such as metal, polymer, composite, or combinations thereof. The stop element 144 may be fixed to the second bar 130 by welds, solders, brazes, adhesives, mechanical fasteners, or combinations thereof. The stop element 144 is sized to prohibit passage into the hole 142.

FIG. 17A shows the portion of the base 12 and one of the pair of seat supports 32 when the seat support 32 is unbent. That is, when no downward force is applied to the seat 16 (FIG. 1). The stop element 144 is spaced from the base 12 such that a gap G is formed when the seat support 32 is unbent. As downward force is initially applied to the seat 16, the seat support 32 bends downward, exhibiting a first bending stiffness provided by the bending stiffness of the first bar 128. The second bar 130 does not bend, but moves rearward through the hole 142, moving the stop element 144 closer to the base 12 and decreasing the gap G between the stop element 144 and the base 12.

FIG. 17B shows the portion of the base 12 and one of the pair of seat supports 32 when the seat support 32 is bent far enough that the stop element 144 contacts the base 12, eliminating the gap G between the stop element 144 and the base 12. As additional downward force is applied to the seat 16 and the seat support 32 continues to bend downward, the second bar 130 must also bend because further movement of the second bar 130 through the hole 142 is prevented by the stop element 144. Thus, as the seat support 32 continues to bend downward, it exhibits a second bending stiffness that is greater than the first bending stiffness because the second bending stiffness is provided by the combination of the bending stiffness of the first bar 128 and the bending stiffness of the second bar 130. The point at which the bending stiffness of the seat support 32 transitions from the first bending stiffness to the second bending stiffness is a stop point. Thus, the action of the stop device 132 between the second bar 130 and the base 12 determines the stop point for the seat support 32 by limiting and extent of movement of the second bar 130 relative to the base 12.

When the seat support 32 is unbent, the gap G may be as small as 0.025 inches, 0.050 inches, 0.075 inches, 0.100 inches, 0.125 inches 0.150 inches, or 0.175 inches, or as large as 0.20 inches, 0.25 inches, 0.30 inches, 0.35 inches, 0.40 inches, 0.45 inches, or 0.50 inches, or within any range defined between any two of the foregoing values, such as 0.025 to 0.5 inches, 0.050 to 0.45 inches, 0.075 to 0.40 inches, 0.100 to 0.35 inches, 0.125 to 0.30 inches, 0.150 to 0.25 inches, 0.175 inches to 0.20 inches, or 0.100 to 0.150 inches, for example Although the hole 142 is illustrated in FIGS. 17A and 17B, and the third end 138 is shown penetrating through the base support 20, it is understood that embodiments include a cavity formed in base support 20 instead of the hole 142 and with the third end 138 contained within the cavity.

Figure 18:
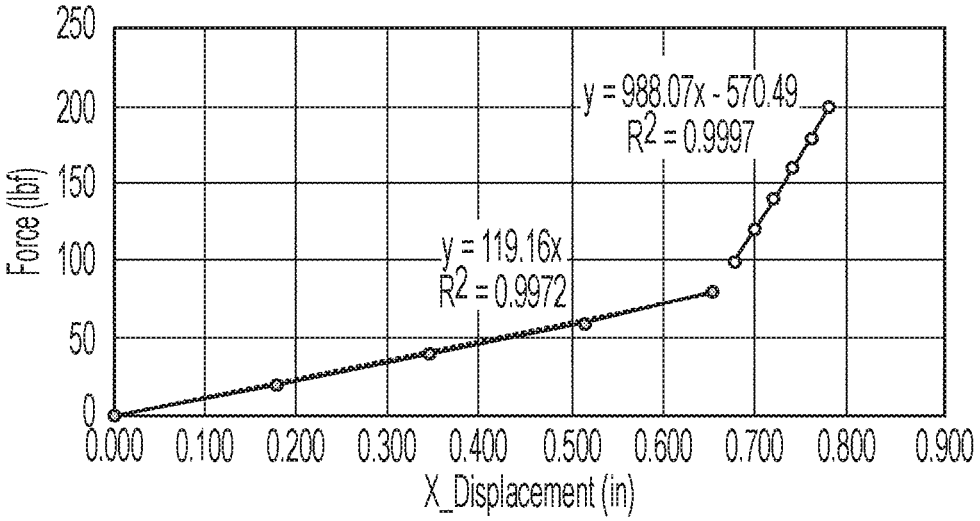
FIG. 18 is a graph illustrating a predicted bending stiffness of the pair of seat supports of FIG. 16.

FIG. 18 is a graph illustrating a predicted bending stiffness of the pair of seat supports 32 of FIG. 16. The prediction was made using Finite Element Analysis on Creo Simulate from PTC. FIG. 18 shows the predicted force required to displace the pair of seat supports 32 downward. As shown in FIG. 18, the initial force required to displace the seat supports 32 downward increases at a rate of about 119 pounds of force per inch of displacement until the stop point is reached at between about 0.65 and 0.68 inches of displacement. After the stop point, the increase in force required to displace the seat supports 32 downward jumps to a rate of nearly 1,000 pounds of force per inch of displacement.

Figure 19:
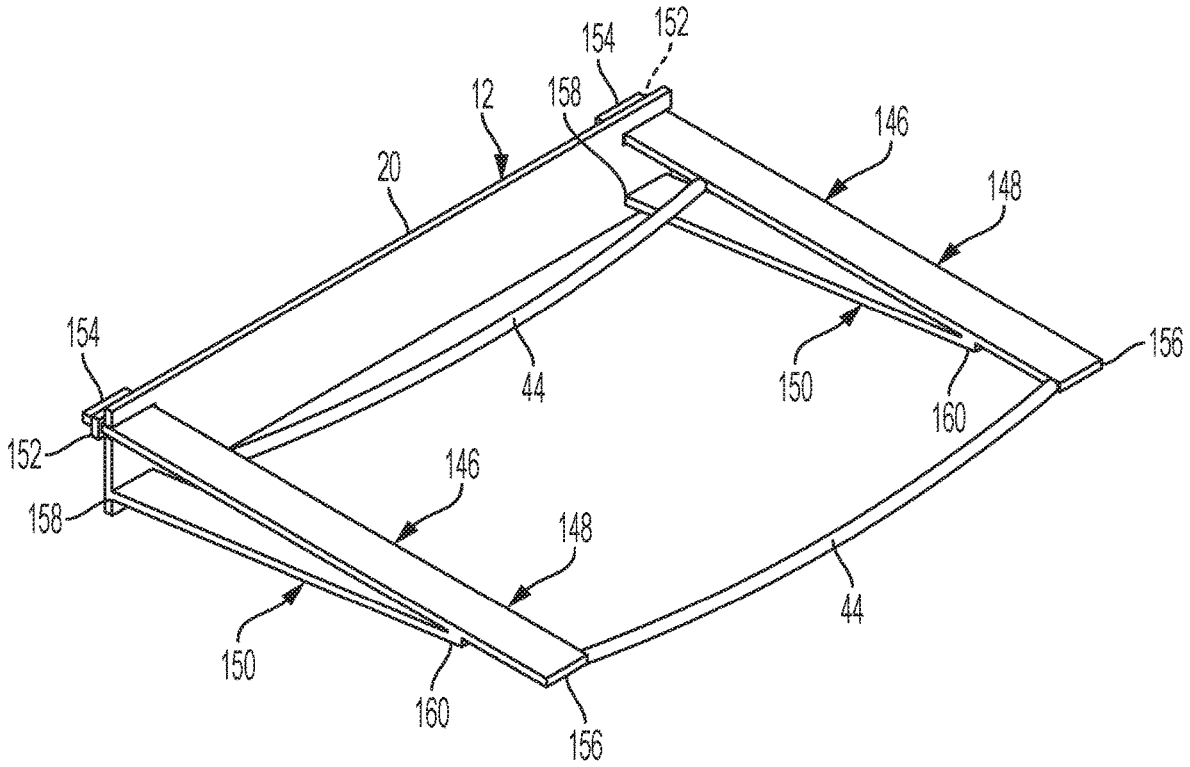
FIG. 19 is a schematic front perspective view of a portion of the base and another pair of seat supports of the chair of FIG. 1, according to some embodiments of this disclosure.

FIG. 19 is a schematic front perspective view of a portion of the base 12 and another pair of seat supports 146 of the chair 10 of FIG. 1, according to some embodiments of this disclosure. The pair of seat supports 146 may be used in chair 10 in place of the pair of seat supports 32 described above. FIG. 19 shows the pair of seat supports 146 extending from the base 12. As shown in FIG. 19, each of the seat supports 146 includes a first bar 148, a second bar 150, and a stop device 152. The first bar 146 includes a first end 154 and a second end 156 opposite the first end 154. The second bar 150 includes a third end 158 and a fourth end 160 opposite the third end 158.

The first bar 148 and the second bar 150 are flexible bars that bend elastically upon the application of downward force to the seat support 146, and spring back to an unbent position upon removal of the rearward force. In the embodiment shown in FIG. 19, the first bar 148 and second bar 150 are illustrated a having a rectangular cross-section. However, it is understood that embodiments may include a first bar 148 and a second bar 150 having other cross-sectional shapes, such as circular, elliptical, triangular, or square, for example.

The first end 154 may be disposed adjacent to the base 12 and is moveable relative to the base 12. The third end 158 is fixed to the base support 20 of the base 12. The third end 158 is spaced apart from the first end 154. The fourth end 160 is fixed to the first bar 148 between the first end 154 and the second end 156. Fixation of the first end 154 to the base support 20 and/or the fourth end 160 to the first bar 148 may be by welds, solders, brazes, adhesives, mechanical fasteners, or any combination thereof.

Figure 20A:
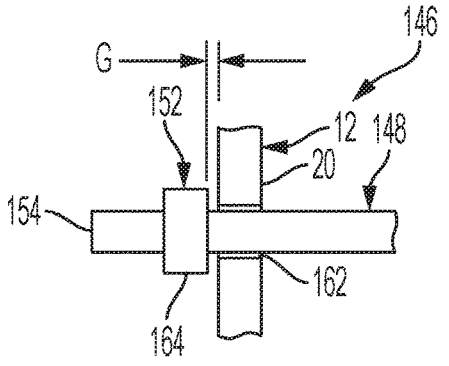
FIGS. 20A and 20B are schematic side views of a portion of the base and one of the pair of seat supports of FIG. 19, according to some embodiments of this disclosure.
Figure 20B:
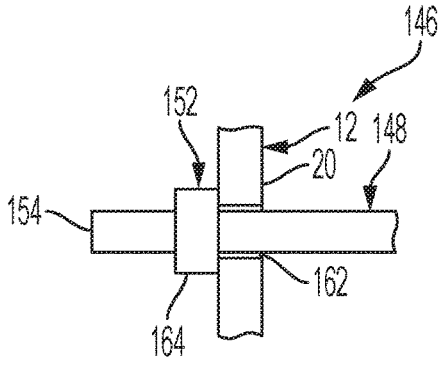

FIGS. 20A and 20B are schematic side views of a portion of the base 12 and one of the pair of seat supports 146 of FIG. 19, according to some embodiments of this disclosure. As shown in FIG. 20A, the stop device 152 may include a hole 162 and a stop element 164. The hole 162 may be formed in the base support 20 of the base 12. In this embodiment, the hole 162 is open on one side (visible in FIG. 19). The hole 162 may be sized to permit unrestricted passage of the first bar 148. The stop element 164 is fixed to, and projects from, the first bar 148. The stop element 164 is disposed between the first end 152 and the base 12. The stop element 144 may be formed of any sturdy material that may be fixed to the first bar 148, such as metal, polymer, composite, or combinations thereof. The stop element 164 may be fixed to the first bar 148 by welds, solders, brazes, adhesives, mechanical fasteners, or combinations thereof. The stop element 164 is sized to prohibit passage into the hole 162.

FIG. 20A shows the portion of the base 12 and one of the pair of seat supports 146 when the seat support 146 is unbent. That is, when no downward force is applied to the seat 16 (FIG. 1). The stop element 164 is spaced from the base 12 such that a gap G is formed when the seat support 146 is unbent. As downward force is initially applied to the seat 16, the seat support 146 bends downward, exhibiting a first bending stiffness provided by the bending stiffness of the second bar 150. The first bar 148 does not bend, but moves through the hole 162, moving the stop element 164 closer to the base 12 and decreasing the gap G between the stop element 164 and the base 12.

FIG. 20B shows the portion of the base 12 and one of the pair of seat supports 146 when the seat support 146 is bent far enough that the stop element 164 contacts the base 12, eliminating the gap G between the stop element 164 and the base 12. As additional downward force is applied to the seat 16 and the seat support 146 continues to bend downward, the first bar 148 must also bend because further movement of the first bar 148 through the hole 162 is prevented by the stop element 164. Thus, as the seat support 146 continues to bend downward, it exhibits a second bending stiffness that is greater than the first bending stiffness because the second bending stiffness is provided by the combination of the bending stiffness of the first bar 148 and the bending stiffness of the second bar 150. The point at which the bending stiffness of the seat support 146 transitions from the first bending stiffness to the second bending stiffness is a stop point. Thus, the action of the stop device 152 between the first bar 148 and the base 12 determines the stop point for the seat support 146 by limiting and extent of movement of the first bar 148 relative to the base 12.

Figure 21:
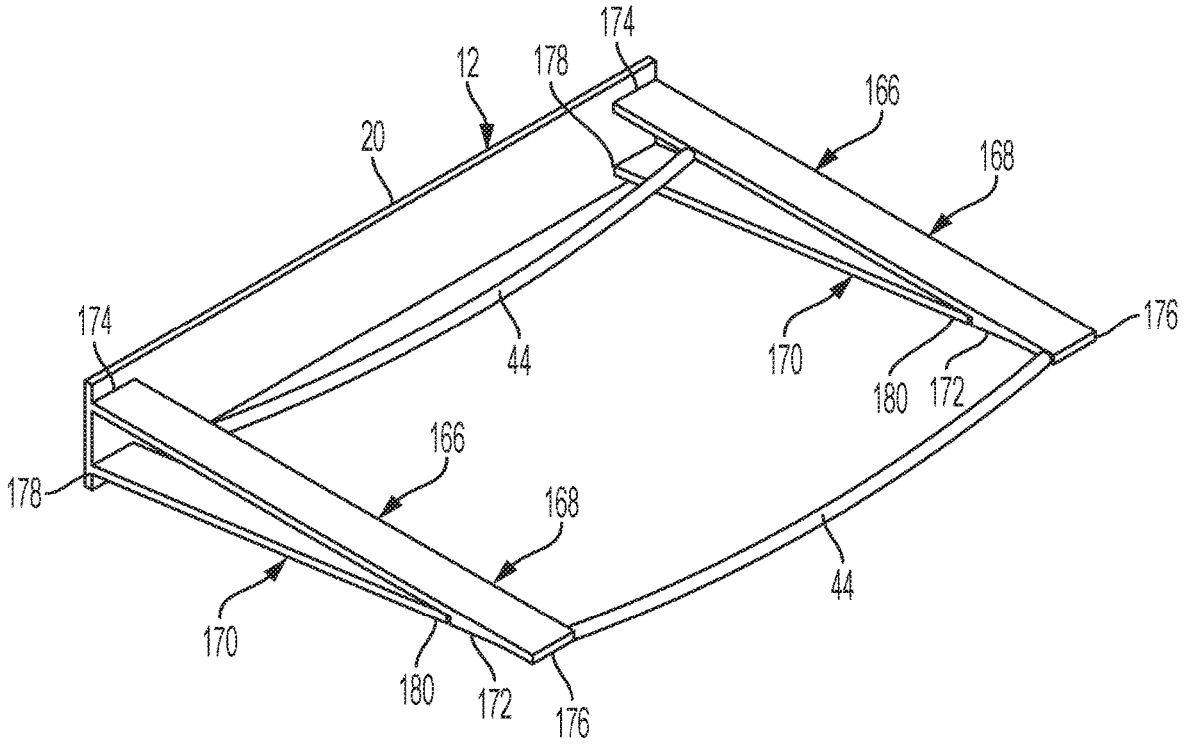
FIG. 21 is a schematic front perspective view of a portion of the base and yet another pair of seat supports of the chair of FIG. 1, according to some embodiments of this disclosure.

When the seat support 146 is unbent, the gap G may be as small as 0.025 inches, 0.050 inches, 0.075 inches, 0.100 inches, 0.125 inches 0.150 inches, or 0.175 inches, or as large as 0.20 inches, 0.25 inches, 0.30 inches, 0.35 inches, 0.40 inches, 0.45 inches, or 0.50 inches, or within any range defined between any two of the foregoing values, such as 0.025 to 0.5 inches, 0.050 to 0.45 inches, 0.075 to 0.40 inches, 0.100 to 0.35 inches, 0.125 to 0.30 inches, 0.150 to 0.25 inches, 0.175 inches to 0.20 inches, or 0.100 to 0.150 inches, for example FIG. 21 is a schematic front perspective view of a portion of the base 12 and yet another pair of seat supports 166 of the chair of FIG. 1, according to some embodiments of this disclosure. The pair of seat supports 166 may be used in chair 10 in place of the pair of seat supports 32 described above. FIG. 21 shows the pair of seat supports 166 extending from the base 12. As shown in FIG. 21, each of the seat supports 166 includes a first bar 168, a second bar 170, and a stop device 172. The first bar 168 includes a first end 174 and a second end 176 opposite the first end 174. The second bar 170 includes a third end 178 and a fourth end 180 opposite the third end 178. The first bar 168 and the second bar 170 may be substantially similar to the first bar 148 and the second bar 150 described above with respect to flexibility and cross-sectional shapes.

The first end 174 may fixed to the base 12. The third end 178 may also be fixed to the base 12, and be spaced apart from the first end 174. The fourth end 180 is disposed adjacent to the first bar 168 between the first end 174 and the second end 176. The fourth end 180 is in sliding engagement with the first bar 168. Fixation of the first end 174 and/or the third end 178 to the base support 20 of the base 12 may be by welds, solders, brazes, adhesives, mechanical fasteners, or any combination thereof.

Figure 22A:
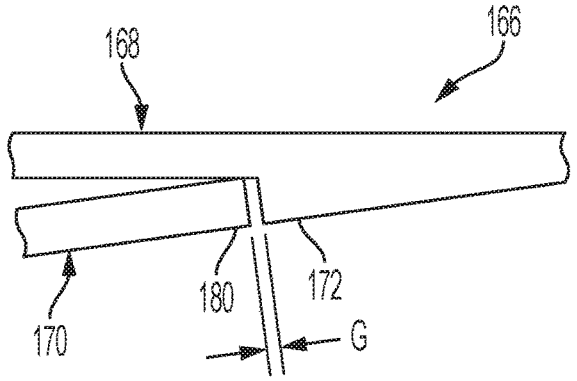
FIGS. 22A and 22B are schematic side views of a portion of the base and one of the pair of seat supports of FIG. 21, according to some embodiments of this disclosure.
Figure 22B:
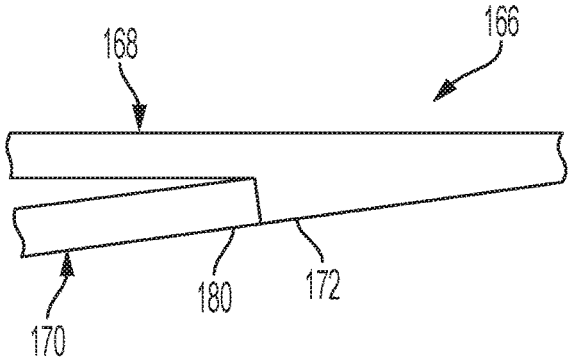

FIGS. 22A and 22B are schematic side views of a portion of the base and one of the pair of seat supports 166 of FIG. 21, according to some embodiments of this disclosure. As shown in FIG. 22A, the stop device 172 may project from the first bar 168. The stop device 108 may be formed of any sturdy material that may be fixed to the first bar 168, such as metal, polymer, composite, or combinations thereof. In some embodiments, the stop device 172 may be integrally formed with the first bar 168, as shown in FIGS. 22A and 22B. In some other embodiments, the stop device 172 may be fixed to the first bar 168 by welds, solders, brazes, adhesives, mechanical fasteners, or combinations thereof.

FIG. 22A shows the portion one of the pair of seat supports 166 when the seat support 166 is unbent. That is, when no downward force is applied to the seat 16 (FIG. 1). The stop device 172 is disposed along the first bar 168 such that a gap G between the first stop device 172 and fourth end 180 is formed when the seat support 166 is unbent. As downward force is initially applied to the seat 16, the seat support 166 bends downward, exhibiting a first bending stiffness provided by the bending stiffness of the first bar 168. The second bar 170 slides along the first bar 168, decreasing the gap G between the first stop device 172 and the fourth end 180. The second bar 170 also contributes to the first bending stiffness, but to a lesser degree because the sliding action reduces the amount of bending by the second bar 180.

FIG. 22B shows the portion of one of the pair of seat supports 166 when the seat support 166 is bent far enough that the fourth end 180 contacts the stop device 172, eliminating the gap G. As additional downward force is applied to the seat 16 and the seat support 166 continues to bend downward, the second bar 170 must bend fully along with the first bar 168 because further movement of the second bar 170 along the first bar 168 is prevented by the stop device 172. Thus, as the seat support 166 continues to bend downward, it exhibits a second bending stiffness that is greater than the first bending stiffness because the second bending stiffness is provided by the combination of the bending stiffness of the first bar 168 and the full bending stiffness of the second bar 170. The point at which the bending stiffness of the seat support 166 transitions from the first bending stiffness to the second bending stiffness is a stop point. Thus, the action of the stop device 172 between the fourth end 180 and the first bar 166 determines the stop point for the seat support 166 by limiting and extent of the sliding engagement of the fourth end 180 with the first bar 168.

When the seat support 166 is unbent, the gap G may be as small as 0.025 inches, 0.050 inches, 0.075 inches, 0.100 inches, 0.125 inches 0.150 inches, or 0.175 inches, or as large as 0.20 inches, 0.25 inches, 0.30 inches, 0.35 inches, 0.40 inches, 0.45 inches, or 0.50 inches, or within any range defined between any two of the foregoing values, such as 0.025 to 0.5 inches, 0.050 to 0.45 inches, 0.075 to 0.40 inches, 0.100 to 0.35 inches, 0.125 to 0.30 inches, 0.150 to 0.25 inches, 0.175 inches to 0.20 inches, or 0.100 to 0.150 inches, for example Thus, the chair 10 including the seat 16 with the any of the pair of seat supports 32, 146, or 166 described above flexes along the length of the seat supports 32, 146, or 166, with the higher strain near the hip point where an occupant's leg naturally rotates downward. This feature may allow more contact area between the seat and the occupant, reducing overall pressure on the occupant and providing a more gradual change in pressure near the area under the occupant's knees. Thus, chair 10 may provide better comfort during recline and when changing postures during task-relate movements, and stretching. Advantageously, the stiffness of the seat 16 varies based on the amount of deflection, reducing pressure during recline and lowing a forward tilt of one or both of the occupant's legs when changing postures. The initial stiffness is low, comfortably allowing a prescribed amount of movement by the occupant. Once movement exceeds the prescribed amount, and the first stop point is reached, the stiffness increases significantly to safely support the occupant.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A chair comprising:

a base; and a seat coupled to the base, the seat including:

a pair of seat supports extending from the base, each of the seat supports configured to independently exhibit a first bending stiffness when bent to a stop point, and a first component is disposed apart from a second component when the pair of seat supports exhibit the first bending stiffness and until bent to the stop point, and exhibit a second bending stiffness when bent beyond the stop point, the second bending stiffness being greater than the first bending stiffness, and the first component contacts the second component when the pair of seat supports exhibit the second bending stiffness and when bent beyond the stop point; and a seat support surface coupled to the pair of seat supports.

2. A chair comprising:

a base; and a seat coupled to the base, the seat including:

a pair of seat supports extending from the base, each of the seat supports configured to independently exhibit a first bending stiffness when bent to a stop point, and exhibit a second bending stiffness when bent beyond the stop point, the second bending stiffness being greater than the first bending stiffness;

a seat support surface coupled to the pair of seat supports;

wherein each of the seat supports includes:

a first bar including a first end and a second end opposite the first end, the first end fixed to the base;

a second bar including a third end and a fourth end opposite the third end, the third end disposed adjacent to the base and movable relative to the base, the third end spaced apart from the first end, the fourth end fixed to the first bar between the first end and the second end; and a stop device acting between the second bar and the base to determine the stop point by limiting an extent of movement of the second bar relative to the base.

3. The chair of claim 2, wherein the stop device includes:

a hole or cavity formed in a surface of the base, the hole or cavity sized to permit unrestricted passage of the second bar; and a stop element fixed to and projecting from the second bar, the stop element sized to prohibit passage into the hole or cavity, the stop element disposed between the fourth end and the base, and spaced apart from the base by a gap to determine the stop point at which the stop element limits the passage of the second bar into the hole or cavity as the seat support is bent.

4. A chair comprising:

a base; and a seat coupled to the base, the seat including:

a pair of seat supports extending from the base, each of the seat supports configured to independently exhibit a first bending stiffness when bent to a stop point, and exhibit a second bending stiffness when bent beyond the stop point, the second bending stiffness being greater than the first bending stiffness;

a seat support surface coupled to the pair of seat supports;

wherein each of the seat supports includes:

a first bar including a first end and a second end opposite the first end, the first end disposed adjacent to the base and moveable relative to the base;

a second bar including a third end and a fourth end opposite the third end, the third end fixed to the base apart from the first end, the fourth end fixed to the first bar between the first end and the second end; and a stop device acting between the first bar and the base to determine the first stop point by limiting the extent of movement of the first end relative to the base.

5. The chair of claim 4, wherein the stop device includes:

a hole formed in a surface of the base, the hole sized to permit unrestricted passage of the first bar; and a stop element projecting from the first bar, the stop element sized to prohibit passage into the hole, the stop element disposed between the first end and the base, and spaced from the first end to determine the stop point at which the stop element limits the passage of the first bar through the hole as the seat support is bent.

6. A chair comprising:

a base; and a seat coupled to the base, the seat including:

a pair of seat supports extending from the base, each of the seat supports configured to independently exhibit a first bending stiffness when bent to a stop point, and exhibit a second bending stiffness when bent beyond the stop point, the second bending stiffness being greater than the first bending stiffness;

a seat support surface coupled to the pair of seat supports;

wherein each of the seat supports includes:

a first bar including a first end and a second end opposite the first end, the first end fixed to the base;

a second bar including a third end and a fourth end opposite the third end, the third end fixed to the base, the third end spaced apart from the first end, the fourth end disposed adjacent to the first bar between the first end and the second end, the fourth end in sliding engagement with a surface of the first bar; and a stop device acting between the fourth end and the first bar to determine the stop point by limiting an extent of sliding engagement of the fourth end with the first bar.

7. The chair of claim 6, wherein the stop device includes:

a stop element projecting from the first bar, the stop element disposed along the first bar to determine the stop point such that the stop element limits the sliding engagement of the fourth end along the first bar as the seat support is bent enough to bring the fourth end into contact with the first stop element.

* * * * *